US010976034B2

(12) United States Patent
Qiu

(10) Patent No.: US 10,976,034 B2
(45) Date of Patent: Apr. 13, 2021

(54) FOLDABLE LAMP

(71) Applicant: Ningbo Futai Electric Limited, Zhejiang (CN)

(72) Inventor: Fujun Qiu, Ningbo (CN)

(73) Assignee: Ningbo Futai Electric Limited, Zhejiang (CN)

( * ) Notice: Subject to any disclaimer, the term of this patent is extended or adjusted under 35 U.S.C. 154(b) by 265 days.

(21) Appl. No.: 15/889,102

(22) Filed: Feb. 5, 2018

(65) Prior Publication Data

US 2018/0224101 A1 Aug. 9, 2018

(30) Foreign Application Priority Data

Feb. 4, 2017 (CN) ..... 201710064336.8

(51) Int. Cl.

| | |
|---|---|
| ***F21V 21/28*** | (2006.01) |
| ***F21V 21/06*** | (2006.01) |
| *F21V 29/70* | (2015.01) |
| *F21V 17/00* | (2006.01) |

(52) U.S. Cl.

CPC ..... *F21V 21/28* (2013.01); *F21V 21/06* (2013.01); *F21V 17/007* (2013.01); *F21V 29/70* (2015.01)

(58) Field of Classification Search

CPC ..... F21V 21/28; F21V 21/29; F21V 21/30; F21V 21/14; F21V 21/26; F21V 21/145; F21V 21/06; F21V 29/70; F21V 17/007

See application file for complete search history.

(56) References Cited

U.S. PATENT DOCUMENTS

| | | | | |
|---|---|---|---|---|
| 6,022,119 | A * | 2/2000 | Booty, Jr. | F21V 27/00 362/419 |
| 9,182,108 | B2 * | 11/2015 | Hsieh | F21S 6/003 |
| 2003/0076670 | A1 * | 4/2003 | Siegel | A63F 13/02 362/85 |
| 2011/0140640 | A1 * | 6/2011 | Lu | F21S 6/003 315/362 |
| 2011/0141737 | A1 * | 6/2011 | Gu | F21S 6/003 362/249.1 |

FOREIGN PATENT DOCUMENTS

| | | | | |
|---|---|---|---|---|
| CN | 204062814 U | * | 12/2014 | F21V 21/30 |

* cited by examiner

*Primary Examiner* — Rajarshi Chakraborty
*Assistant Examiner* — Fatima N Farokhrooz
(74) *Attorney, Agent, or Firm* — Raymond Y. Chan; David and Raymond Patent Firm

(57) ABSTRACT

A foldable lamp includes a lamp body, a supporting unit and a connecting device. The connecting device includes a first connecting unit and a second connecting unit. The supporting unit includes a first supporting structure and a second supporting structure. The first supporting structure is rotatably connected with the lamp body through the first connecting unit. The second supporting structure is rotatably connected with the first supporting structure through the second connecting unit. The lamp is placed on a horizontal or hung on a hanger through the second supporting structure.

11 Claims, 14 Drawing Sheets

FOLDABLE LAMP

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a lamp, and more particularly to a foldable lamp.

Description of Related Arts

There are lamps of various structures in the market to meet customer uses and needs in different contexts. Types of lamp are numerous, while they mostly contain structures like gripping structure, handhold structure, wearing structure, and etc. Therefore, a user may utilize the lamp through gripping, handholding or wearing it for illumination. Nevertheless, people sometimes have both of their hands full in their daily life or work that they do not have a free hand to hold the lamp. Occasionally, people may need to put a lamp on the table or stage or to hang it on some hanger in order to provide enough illumination for their office work.

A conventional foldable lamp usually has a lamp body, a clamping portion, and a bendable connector connecting the lamp body and the clamping portion and allowing the lamp body to rotate in a certain predetermined angle. The clamping portion can clamp and hold on a fixed surface, so as to place the lamp body. Unfortunately, if there is no suitable space for clamping in a real case, this type of lamp will fail to be steadily used. Besides, its connector can be broken or damaged when it is bent over for a long period of time. Also, some conventional lamps in the market substitute the clamping portion with a base, such that the lamp can be placed on a horizontal through the base. Nonetheless, if there is no suitable plane surface during the course, it will not be able to be placed and utilized. Therefore, its useage is very limited. The lamps with multiple placing arrangements in current market usually have larger size consequently, which influences their production costs, packaging costs, and usability. Hence, a challenge for the lamp industry nowadays is to develop a compact lamp with various placing arrangement.

SUMMARY OF THE PRESENT INVENTION

An object of the present invention is to provide a foldable lamp, wherein the foldable lamp provides a lamp body, a connecting device, and a supporting unit, wherein the lamp body is rotatably connected to the supporting unit through the connecting device so as to provide a variety of placements of the foldable lamp by means of the supporting unit.

Another object of the present invention is to provide a foldable lamp, wherein the lamp body is rotatably connected to the supporting unit, so as to allow the illumination angle of the lamp body be adjusted based on the user needs, which helps to enhance the utility thereof.

Another object of the present invention is to provide a foldable lamp, wherein the lamp body can be held at the adjusted position, so as to enhance the reliability of the foldable lamp in use. In other words, the lamp body is able to be kept still when there is no external force acting on the lamp body or the folding unit.

Another object of the present invention is to provide a foldable lamp, wherein the lamp body can be placed on a horizontal placement surface or hung on an object so as to satisfy various service environments of the lamp.

Another object of the present invention is to provide a foldable lamp, wherein the supporting unit provides a first supporting structure and a second supporting structure, wherein the connecting device provides a first connecting unit and a second connecting unit, wherein the first supporting structure is rotatably connected to the lamp body through the first connecting unit, wherein the second supporting structure is rotatably connected to the first supporting structure through the second connecting unit, such that the lamp body, the first supporting structure, and the second supporting structure are all rotatably foldable among one another.

Another object of the present invention is to provide a foldable lamp, wherein at least one supporting structure between the first supporting structure and the second supporting structure is an U-shaped structure, so as to allow the lamp to be placed on a plane surface or hung on a hanger through the U-shaped structure, such that the lamp can provide a variety of ways of layout.

Another object of the present invention is to provide a foldable lamp, wherein the first connecting unit provides a first connector and a second connector, wherein the first connector is provided on the lamp body, wherein the second connector is provided on the first supporting structure, wherein the first connector and the second connector are rotatably engaged through meshing therebetween.

Another object of the present invention is to provide a foldable lamp, wherein alternatively the first connector is provided on the first supporting structure and the second connector is provided on the lamp body, wherein the first connector and the second connector are rotatably and foldably engaged through meshing therebetween.

Another object of the present invention is to provide a foldable lamp, wherein the supporting unit is foldably connected to the lamp body, so as to provide a compact structure for the foldable lamp, which helps to reduce the spaces of packaging and placing. In other words, the lamp body can be hidden in the inside of the supporting unit. Besides, when the foldable lamp is carried with or transported, the supporting unit can also protect the lamp body from the outside thereof, which means the supporting unit can serve as a buffer.

Another object of the present invention is to provide a foldable lamp, wherein the connecting device can be detachably connected to the supporting unit, so as to be friendly for the user to replace or disassemble the connecting device.

Another object of the present invention is to provide a foldable lamp, wherein the first connecting unit further provides a third connector, wherein the third connector strengthens the connection between the first connector and the second connector and holds the first supporting structure and the lamp body on the adjusted angle.

Another object of the present invention is to provide a foldable lamp, wherein the second connecting unit provides a fourth connector and a fifth connector, wherein the fourth connector is provided on the second supporting structure, wherein the fifth connector is provided on the first supporting structure, wherein the fourth connector and the fifth connector are rotatably engaged through meshing therebetween.

Another object of the present invention is to provide a foldable lamp, wherein the second connecting unit provides a sixth connector, wherein the sixth connector strengthens the connection between the third connector and the fourth connector and holds the second supporting structure and the first supporting structure on the adjusted angle.

Another object of the present invention is to provide a foldable lamp, wherein the fourth connector is provided on the first supporting structure and the fifth connector is provided on the second supporting structure, wherein the fourth connector and the fifth connector are rotatably and foldably engaged through meshing therebetween.

Another object of the present invention is to provide a foldable lamp, wherein the second supporting structure is directly rotatably connected to the lamp body through the second connecting unit so as to rotatably connect the second supporting structure and the lamp body.

Another object of the present invention is to provide a foldable lamp, wherein the first connector, the second connector, the third connector, and the fourth connector are made of binding material, such that the first connector can be rotatably connected with the second connector and the third connector can be rotatably connected with the fourth connector.

In order to achieve one or more of the above objects, the present invention provide a foldable lamp, which comprises a lamp body, a supporting unit, and a connecting device, wherein the connecting device comprises a first connecting unit and a second connecting unit, wherein the supporting unit is rotatably connected with the lamp body through the first connecting unit and the second connecting unit.

In a preferred embodiment, the supporting unit comprises a first supporting structure and a second supporting structure, wherein the first supporting structure is rotatably connected with the lamp body through the first connecting unit, wherein the second supporting structure is rotatably connected with the first supporting structure through the second connecting unit.

In a preferred embodiment, the lamp body comprises a shell, at least a light source, and a photopermeable element, wherein the light source is provided in a chamber of the shell, wherein the photopermeable element is arranged on the shell, so as to allow light generated by the light source to be transmitted through the photopermeable element to the outside.

In a preferred embodiment, the first supporting structure comprises a first bracket and a second bracket, wherein the first bracket and the second bracket are rotatably connected with two extension portions of the shell respectively through the first connecting unit.

In a preferred embodiment, the first connecting unit comprises a first connector and a second connector, wherein the first connector is provided on the extension portion, wherein the second connector is provided on the first supporting structure, wherein the first connector is rotatably connected to the second connector, such that the first bracket and the second bracket are rotatably connected with the shell.

In a preferred embodiment, the first connector comprises a first bottom end portion and a first meshing portion, wherein the first meshing portion is provided on the first bottom end portion, wherein the first bottom end portion is connected with the extension portion.

In a preferred embodiment, the second connector comprises a first connecting portion and a first extension portion, wherein the first connecting portion has a first clamping portion, wherein the first clamping portion is meshingly connected with the first meshing portion, such that the first connector is rotatably connected with the second connector.

In a preferred embodiment, the first connector comprises a first guiding pillar, wherein the first connecting portion has a first perforation, wherein the first extension portion has a second perforation, wherein the first guiding pillar penetrates into the first perforation and the second perforation to strengthen the connection between the first connector and the second connector.

In a preferred embodiment, the first connecting unit comprises a first flake and a first locking piece, wherein the first flake has a first connecting hole, wherein the first guiding pillar has a first mounting hole, wherein the first locking piece penetrated the first connecting hole is connected on the first mounting hole so as to strengthen the connection between the first connector and the second connector.

In a preferred embodiment, the third connector comprises a first resilient element, wherein the first resilient element is arranged on the first guiding pillar, wherein the first resilient element maintains the adjusted status of the first bracket and the second bracket.

In a preferred embodiment, the second connecting unit comprises a fourth connector and a fifth connector, wherein the fourth connector is provided on two the end portion of the second supporting structure, wherein the fifth connector is provided on the first supporting structure, wherein the fourth connector is rotatably connected with the fifth connector, such that the first bracket is rotatably connected with the second bracket.

In a preferred embodiment, the fourth connector comprises a second bottom end portion and a second meshing portion, wherein the second meshing portion is provided on the second bottom end portion, wherein the second bottom end portion is connected with the end portion.

In a preferred embodiment, the fifth connector comprises a second connecting portion and a second extension portion, wherein the second connecting portion has a second clamping portion, wherein the second clamping portion is meshingly connected with the second meshing portion, such that the fourth connector is rotatably connected with the fifth connector.

In a preferred embodiment, the fourth connector comprises a second guiding pillar, wherein the second connecting portion has a third perforation, wherein the second extension portion has a fourth perforation, wherein the second guiding pillar penetrates into the third perforation and the fourth perforation to strengthen the connection between the fourth connector and the fifth connector.

In a preferred embodiment, the fourth connecting unit comprises a second flake and a second locking piece, wherein the second flake has a second connecting hole, wherein the second guiding pillar has a second mounting hole, wherein the second locking piece penetrated the second connecting hole is connected on the second mounting hole so as to strengthen the connection between the fourth connector and the fifth connector.

In a preferred embodiment, the sixth connector comprises a second resilient element, wherein the second resilient element is arranged on the second guiding pillar, wherein the second resilient element maintains the adjusted status of the second supporting structure toward the first supporting structure.

In a preferred embodiment, the first bracket has a first upper end portion, wherein the second bracket has a second upper end portion, wherein the first upper end portion and the second upper end portion respectively have a first mounting cavity and a second mounting cavity, wherein the second connector, the first extension portion, the first flake, and the first resilient element are in the second mounting cavity.

In a preferred embodiment, the first bracket has a first lower end portion, wherein the second bracket has a second lower end portion, wherein the first lower end portion and the second lower end portion respectively have a third mounting cavity and a fourth mounting cavity, wherein the fifth connector, the second extension portion, the second flake, and the second resilient element are in the fourth mounting cavity.

In a preferred embodiment, the first connector and the second connector are both made of magnetic material, wherein the first connector is rotatably connected with the second connector, such that the first supporting structure is connected with the lamp body.

In a preferred embodiment, the fourth connector and the fifth connector are both made of magnetic material, wherein the fourth connector is rotatably connected with the fifth connector, such that the second supporting structure is connected with the first bracket or the lamp body.

In a preferred embodiment, the second supporting structure is a U-shaped structure, wherein the lamp is placed on a horizontal or hung on a hanger through the second bracket.

According to another aspect of the present invention, the present invention further provides a foldable lamp, which comprises:

a supporting unit, providing an accommodation; and a lamp body, rotatably arranged on the supporting unit, such that the foldable lamp has a collapsed state and an expanded state to be switched therebetween, wherein when the foldable lamp is in the collapsed state, the lamp body is accommodated in the accommodation of the supporting unit, such that the supporting unit surrounds around the lamp body, which reduces the volume of the foldable lamp under the collapsed state.

According to an embodiment of the present invention, the supporting unit comprises two support arms and a connecting portion, wherein each support arm is respectively integrally and curvedly extended from the connecting portion so as to form the accommodation among the support arms and the connecting portion, wherein the free ends of the support arms are respectively rotatably arranged on two sides of the lamp body, such that the support arms are respectively on the two sides of the lamp body when the foldable lamp is in the collapsed state.

According to an embodiment of the present invention, the connecting portion forms a crossbeam, wherein the support arms are integrally extended from the two sides of the connecting portion respectively so as to make the supporting unit U-shaped.

According to an embodiment of the present invention, the supporting unit comprises a first supporting structure and a second supporting structure, wherein the first supporting structure further comprises a first bracket and a second bracket symmetrical to the first bracket, wherein a first upper end portion of the first bracket and a second upper end portion of the second bracket are respectively pivotally connected to two sides of the lamp body, wherein two end portions of the second bracket are respectively rotatably connected with the first lower end portion of the first bracket and the second lower end portion of the second bracket.

According to an embodiment of the present invention, the supporting unit comprises a first supporting structure and a second supporting structure, wherein the first supporting structure further comprises a first bracket and a second bracket symmetrical to the first bracket, wherein a first upper end portion of the first bracket and a second upper end portion of the second bracket are respectively pivotally connected to two sides of the lamp body, wherein two end portions of the second bracket are respectively rotatably connected with the first lower end portion of the first bracket and the second lower end portion, wherein the first bracket and part of the second supporting structure form one the support arm, wherein the second bracket and part of the second supporting structure form another the support arm, wherein another part of the second supporting structure forms the connecting portion.

According to an embodiment of the present invention, the foldable lamp further comprises a connecting device, wherein the connecting device comprises two first connecting units and two second connecting units, wherein the first upper end portion of the first bracket and the second upper end portion of the second bracket are respectively rotatably connected to two sides of the lamp body through each the first connecting unit, wherein the end portions of the second supporting structure are respectively rotatably connected with the first lower end portion of the first bracket and the second lower end portion of the second bracket through the second connecting units respectively.

According to an embodiment of the present invention, the first connecting unit comprises a first connector and a second connector, wherein the first connector is provided on the extension portion of the lamp body, wherein the second connector is provided on the first bracket and the second bracket of the first supporting structure, wherein the first connector is rotatably connected with the second connector, such that the first bracket and the second bracket are rotatably connected with the lamp body.

According to an embodiment of the present invention, the first connector comprises a first bottom end portion and a first meshing portion, wherein the first meshing portion is provided on the first bottom end portion, wherein the first bottom end portion is connected with the extension portion, wherein the second connector comprises a first connecting portion and a first extension portion, wherein the first connecting portion has a first clamping portion, wherein the first clamping portion is meshingly connected with the first meshing portion, such that the first connector is rotatably connected with the second connector.

According to an embodiment of the present invention, the first connector comprises a first guiding pillar, wherein the first connecting portion has a first perforation, wherein the first extension portion has a second perforation, wherein the first guiding pillar penetrates the first perforation and the second perforation so as to attach an attaching surface of the first connector and an attaching surface of the second connector, wherein the attaching surface of the first connector and the attaching surface of the second connector have a position tooth respectively, such that the first connector and the second connector stay still by meshing the position tooth of the attaching surface of the first connector and the position tooth of the attaching surface of the second connector.

According to an embodiment of the present invention, the first connecting unit comprises a first flake and a first locking piece, wherein the first flake has a first connecting hole, wherein the first guiding pillar has a first mounting hole, wherein the first locking piece penetrated the first connecting hole is held in the first mounting hole so as to tightly attach an attaching surface of the first connector with an attaching surface of the second connector.

According to an embodiment of the present invention, the first connecting unit comprises a third connector, wherein the third connector comprises a first resilient element, wherein the first resilient element is arranged on the first guiding pillar to reinforce the attachment between the attaching surface of the first connector and the attaching surface of the second connector.

According to an embodiment of the present invention, each the second connecting unit comprises a fourth connector and a fifth connector, wherein the fourth connectors are respectively provided on the two end portions of the second supporting structure, wherein the fifth connectors are provided on the first bracket and the second bracket of the first supporting structure respectively, wherein the fourth connectors are rotatably connected with the fifth connectors, such that the two end portions of the second supporting structure are rotatably connected to the first bracket and the second bracket respectively.

According to an embodiment of the present invention, the fourth connector comprises a second bottom end portion and a second meshing portion, wherein the second meshing portion is provided on the second bottom end portion, wherein the second bottom end portion is connected with the end portion, wherein the fifth connector comprises a second connecting portion and a second extension portion, wherein the second connecting portion has a second clamping portion, wherein the second clamping portion is meshingly connected with the second meshing portion, such that the fourth connector is rotatably connected with the fifth connector.

According to an embodiment of the present invention, the fourth connector comprises a second guiding pillar, wherein the second connecting portion has a third perforation, wherein the second extension portion has a fourth perforation, wherein the second guiding pillar penetrates the third perforation and the fourth perforation so as to attach an attaching surface of the third connector and an attaching surface of the fourth connector, wherein the attaching surface of the third connector and the attaching surface of the fourth connector have a position tooth respectively, so as to allow the third connector and the fourth connector to hold each other still by meshing the position tooth of the attaching surface of the third connector and the position tooth of the attaching surface of the fourth connector.

According to an embodiment of the present invention, the fourth connecting unit comprises a second flake and a second locking piece, wherein the second flake has a second connecting hole, wherein the second guiding pillar has a second mounting hole, wherein the second locking piece penetrated the second connecting hole is held in the second mounting hole so as to tightly attach the attaching surface of the third connector with the attaching surface of the fourth connector.

According to an embodiment of the present invention, the sixth connector comprises a second resilient element, wherein the second resilient element is arranged on the second guiding pillar to reinforce the attachment between the attaching surface of the third connector and the attaching surface of the fourth connector.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
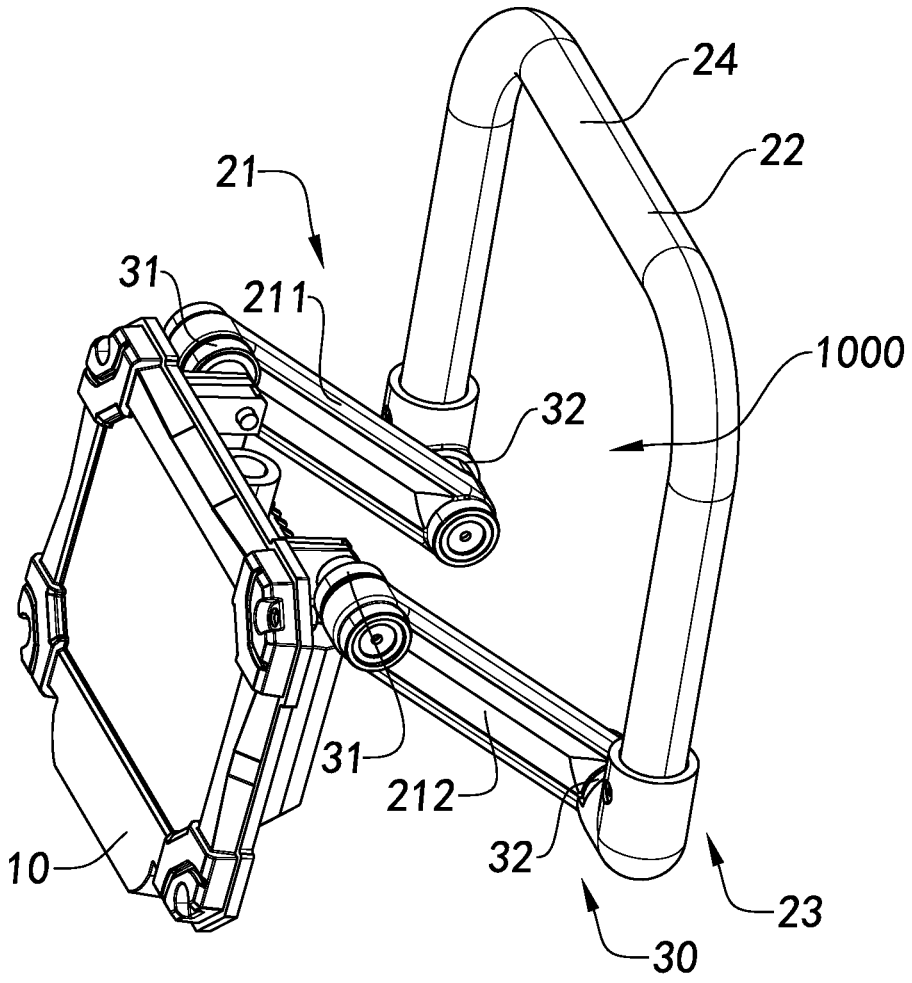
FIG. 1 is an overall perspective view of the foldable lamp according to a first preferred embodiment of the present invention.
Figure 2:
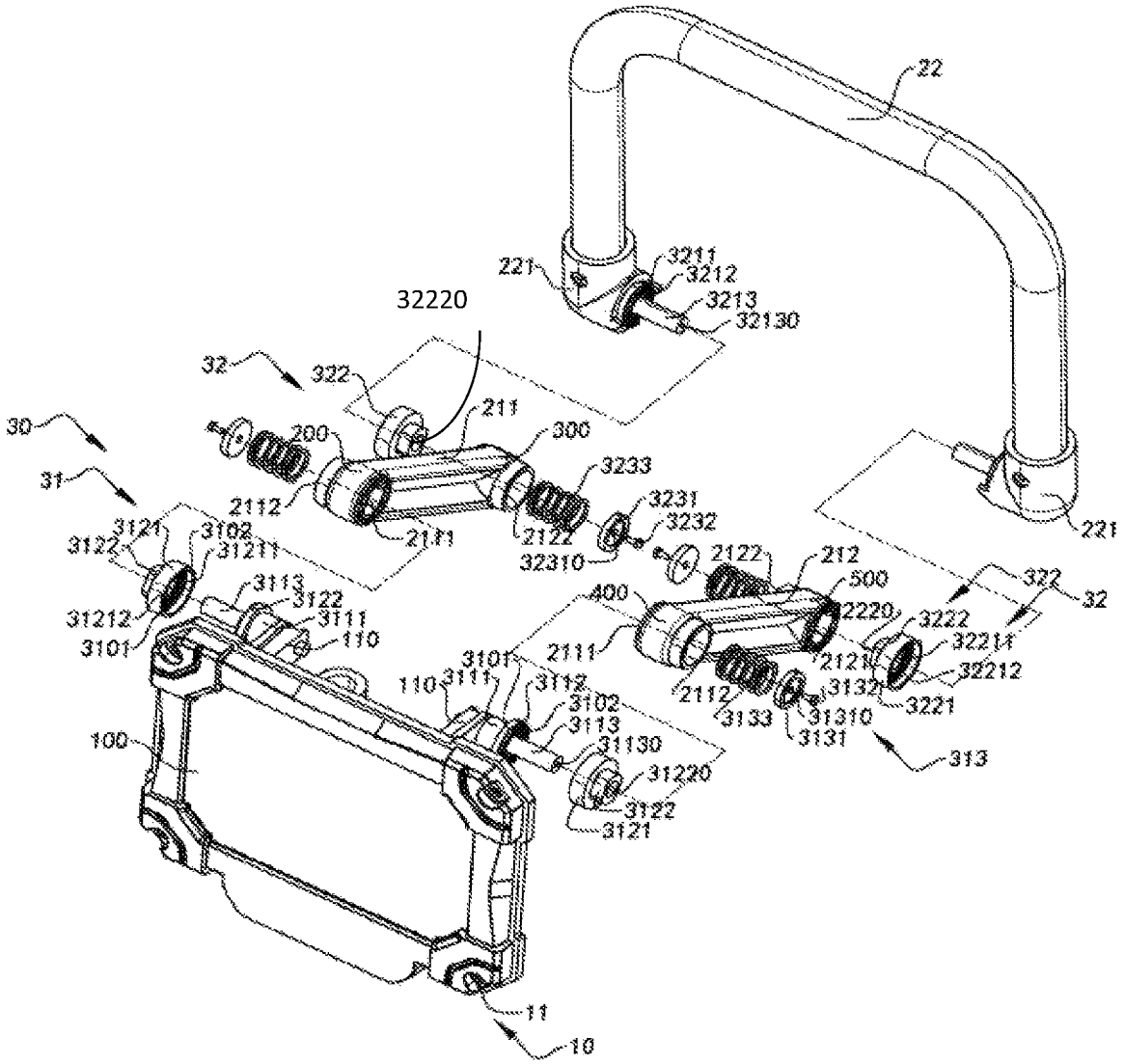
FIG. 2 is an exploded view of the foldable lamp according to the above first preferred embodiment of the present invention.
Figure 3A:
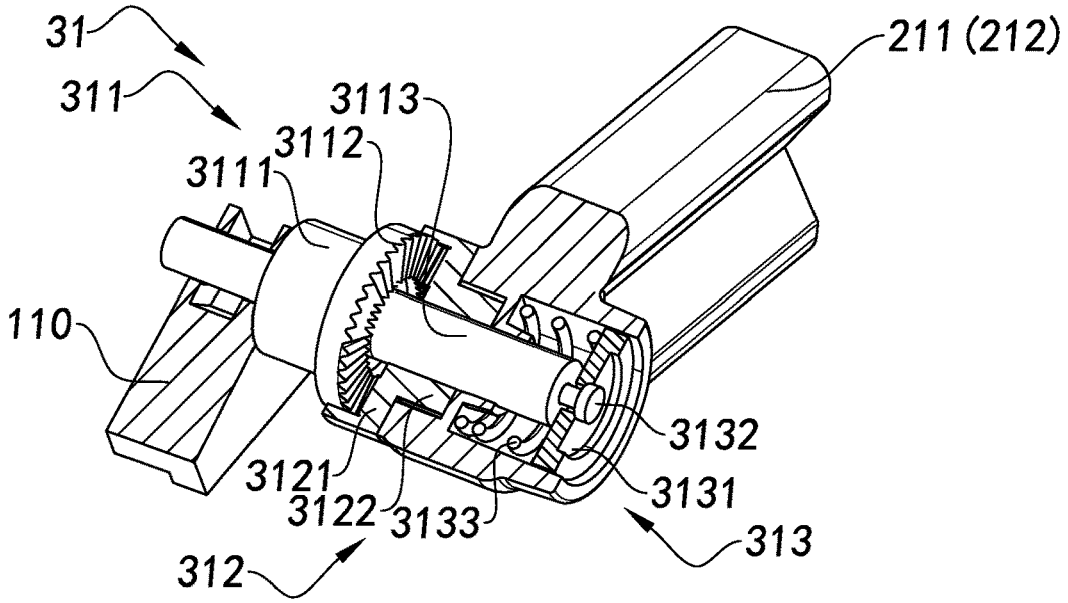
FIGS. 3A and 3B are partially sectional views of the foldable lamp according to the above first preferred embodiment of the present invention.
Figure 3B:
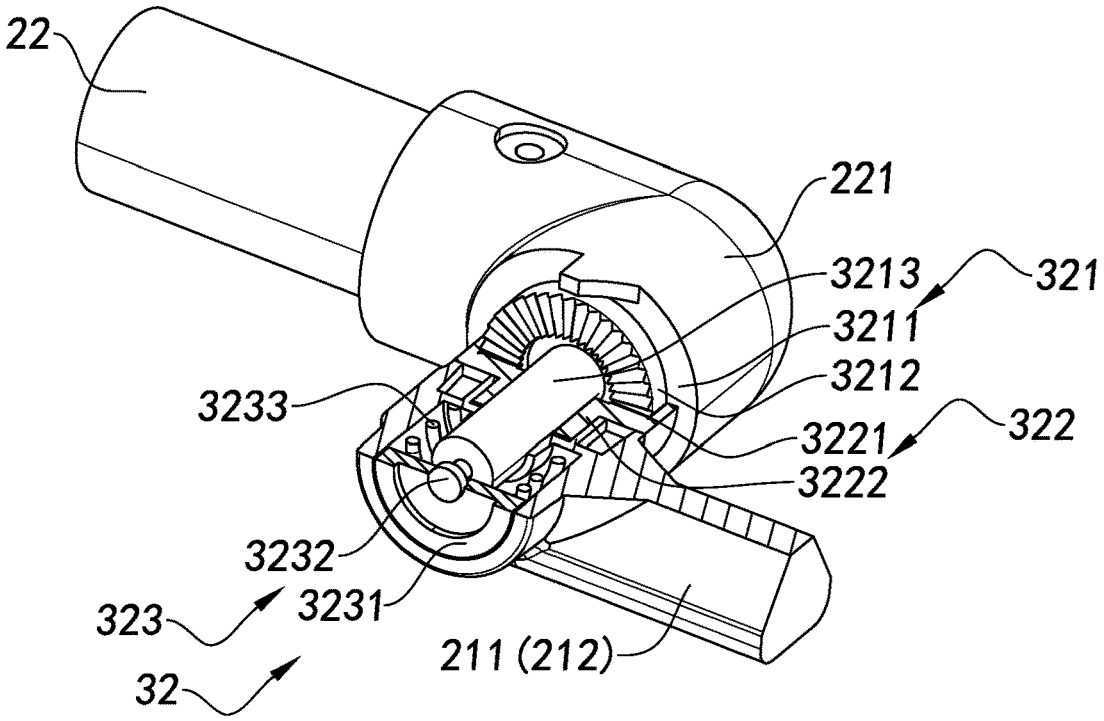

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Embodiment One

Referring to FIGS. 1-8, the present invention provides a foldable lamp according to a first preferred embodiment of the present invention. The foldable lamp comprises a lamp body 10, a supporting unit 20 and a connecting device 30. The lamp body 10 is rotatably connected with the supporting unit 20 through the connecting device 30, such that the lamp body 10, the supporting unit 20, and the connecting device 30 can respectively be folded into a plane structure for reducing the spaces of packaging and storing of the foldable lamp. Besides, the lamp body 10, the supporting unit 20 and the connecting device 30 can be folded toward one another, such that the foldable lamp can be horizontally placed or hung according to the use and need. Also, it allows the user to adjust the illumination angle of the lamp body 10 corresponding to his/her needs.

The lamp body 10 comprises a shell 11, at least a light source 12 and a photopermeable element 13. The light source 12 is arranged in the inside of a chamber 100 of the shell 11. The photopermeable element 13 is arranged on the shell 11 and on the light path of the light generated by the light source 12, so as to allow the light generated by the light source 12 to pass through the photopermeable element 13 and to be radiated to the external environment of the lamp body 10. The photopermeable element 13 and the shell 11 are connected to define the chamber 100. The light source 12 can generate light when electrified. The light will be transmitted through the photopermeable element 13 to the external space or environment to bring about illumination. The shell 11 is a square structure. The light source 12 is arranged at a center of the shell 11. The photopermeable element 13 can also focus light, so as to enhance the illumination result of the light source 12. In addition, the photopermeable element 13 can protect the light source 12 as well. For example, the photopermeable element 13 can be made of transparent glass material or acrylic material. Nevertheless, it is understandable for person skilled in the art that the light source 12 may also be arranged at positions other than the center of the shell 11 and the shell 11 may also have other shapes, such as ellipse, circular, irregular shape, and etc., which can be determined based on the needs.

The supporting unit 20 comprises a first supporting structure 21 and a second supporting structure 22. The first supporting structure 21 is rotatably connected with at least an extension portion 110 of the shell 11 through the connecting device 30. The second supporting structure 22 is rotatably connected with the first supporting structure 21 through the connecting device 30. The lamp body 10 and the first supporting structure 21 may be turned and accommodated into an accommodating chamber 220 defined by the second supporting structure 22, such that the lamp body 10 and the supporting unit 20 are turned into a plane structure, which is compact and user friendly. Alternatively, the lamp body 10 may be placed on a horizontal placement surface or hung on a hanger through the first supporting structure 21 and the second supporting structure 22, which adds service modes to the lamp 1.

The supporting unit 20 further comprises two support arms 23 and a connecting portion 24. The support arms 23 are respectively integrally and curvedly extended from the connecting portion 24 so as to define an accommodation 1000 among the support arms 23 and the connecting portion 24. Further, the connecting portion 24 can also be embodied to be a crossbeam, wherein the support arms 24 are integrally extended from the two sides of the connecting portion 24 respectively so as to make the supporting unit 20 U-shaped.

It is worth mentioning that part of the first supporting structure 21 and part of the second supporting structure 22 can respectively form the support arms 23, while another part of the second supporting structure 22 can form the connecting portion 24.

The foldable lamp has a collapsed state and an expanded state to be switched therebetween. When the foldable lamp is in the collapsed state, the lamp 10 is accommodated in the accommodation 1000 defined by the supporting unit 20, such that the supporting unit 20 surrounds around the lamp body 10, which reduces the volume of the foldable lamp under the collapsed state.

It is worth mentioning that when the foldable lamp is in the collapsed state, the lamp body 10 is hidden inside of the second supporting structure 22, such that it not only reduces the size of the foldable lamp under the collapsed state for carrying with and transportation, but also has the second supporting structure 22 protect the lamp body 10, which keeps the lamp body 10 from being damaged during transportation because the impact acting on the foldable lamp, if any, can only act on the second supporting structure 22 instead of the lamp body 10.

Further, the first supporting structure 21 comprises a first bracket 211 and a second bracket 212. The shell 11 has two extension portions 110 on the upper end of the back thereof respectively. The first bracket 211 and the second bracket 212 are rotatably connected with extension portions 110 respectively through the connecting device 30. When the first bracket 211 and the second bracket 212 are respectively arranged on the shell 11, the first bracket 211 is opposite to the second bracket 212. In other words, there is a certain distance between the first bracket 211 and the second bracket 212. Besides, the mounting positions of the first bracket 211 and the second bracket 212 are on the same level. That is to say, the first bracket 211 and the second bracket 212 of the first supporting structure 21 are arranged on two sides of the shell 11 of the lamp body 10 respectively.

The first bracket 211 has a first upper end portion 200 and a first lower end portion 300. The first upper end portion 200 of the first bracket 211 is rotatably connected with the extension portion 110 through the connecting device 30. The second bracket 212 has a second upper end portion 400 and a second lower end portion 500. The second upper end portion 400 of the second bracket 212 is rotatably connected with the extension portion 110 through the connecting device 30. The first upper end portion 200 of the first bracket 211 has a first mounting cavity 2111 and a second mounting cavity 2112. The second upper end portion 400 of the second bracket 212 also has a first mounting cavity 2111 and a second mounting cavity 2112. The connecting device 30 is respectively arranged in the first mounting cavities 2111 and the second mounting cavities 2112, so as to have the first bracket 211 and the second bracket 212 be rotatably connected with the shell 11 respectively.

The first lower end portion 300 of the first bracket 211 has a third mounting cavity 2121 and a fourth mounting cavity 2122. The second lower end portion 500 of the second bracket 212 also has a third mounting cavity 2121 and a fourth mounting cavity 2122. The connecting device 30 is respectively arranged in the third mounting cavity 2121 and the fourth mounting cavity 2122, so as to have the second supporting structure 22 be rotatably connected with the first bracket 211 and the second bracket 212.

The second supporting structure 22 can be a U-shaped structure having two end portions 221. The second supporting structure 22 is rotatably connected with the first bracket 211 and the second bracket 212 through the end portions 221 respectively. The U-shaped second supporting structure 22 can also be regarded as the resting base of the foldable lamp.

The foldable lamp is able to be placed on a horizontal through the second supporting structure 22 according to user needs. Based on the weight of the lamp body 10, one may adjust the relative positions of the lamp body 10 and the second bracket 22 through the first supporting structure 21 so as to have the foldable lamp be stably placed on the horizontal. The second supporting structure 22 is U-shaped so as to allow the foldable lamp being hung through the second supporting structure 22. The second supporting structure 22 can be hung on a hanger. Illumination angle of the lamp body 10 can then be adjusted through adjusting the angle between the first supporting structure 21 and the second supporting structure 22.

The connecting device 30 comprises two first connecting units 31 and two second connecting units 32. The first bracket 211 and the second bracket 212 are rotatably connected to the extension portions 110 through the first connecting units 31 respectively. The two end portions 221 of the second supporting structure 22 are respectively rotatably connected with the first bracket 211 and the second bracket 212 through the second connecting units 32 respectively.

Further, each the first connecting unit 31 comprises a first connector 311 and a second connector 312. Each the first connector 311 is respectively provided on each the extension portion 110. Each the second connector 312 is respectively provided on the first bracket 211 and the second bracket 212. The meshingly rotating connection between the first connector 311 and the second connector 312 has the first bracket 211 and the second bracket 212 be rotatably connected with the shell 11.

Specifically, the attaching surfaces 3101 of the first connector 311 and the second connector 312 respectively comprise a position tooth 3102 thereon. The attaching surface 3101 of the first connector 311 and the attaching surface 3101 of the second connector 312 are attached to each other, so as to have the position tooth 3102 of the first connector 311 and the position tooth 3102 of the second connector 312 be meshed with each other, such that the lamp body 10 can be held in the adjusted status. An external force can be put on the first connector 311 and the second connector 312 in order to adjust the illumination angle of the lamp body 10. For example, by exerting a force on the lamp body 10 and the supporting unit 20, the force will then act on the first connector 311 and the second connector 312. As a result, the force may overcome the friction between the position tooth 3102 of the first connector 311 and the position tooth 3102 of the second connector 312 and turn the lamp body 10.

Further, the first connector 311 comprises a first bottom end portion 3111 and a first meshing portion 3112, wherein the first meshing portion 3112 is provided on the first bottom end portion 3111. The second connector 312 comprises a first connecting portion 3121 and a first extension portion 3122. The first extension portion 3122 is extended outward from a side of the first connecting portion 3121, such that the first meshing portion 3112 can be meshingly connected to the first connecting portion 3121. The first connecting portion 3121 has a first clamping portion 31211. The first clamping portion 31211 has a tooth structure matching with the first meshing portion 3112. In other words, the tooth structure of the first meshing portion 3112 can coupled with the tooth structure on the first clamping portion 31211, so that the first supporting structure 21 can be rotatably connected with the shell 11 through the meshing between the first meshing portion 3112 and the first clamping portion 31211.

It is understandable that the tooth structure of the first meshing portion 3112 and the tooth structure of the first clamping portion 31211 can also be the above mentioned position tooth 3102 of the first connector 311 and the second connector 312.

It is worth mentioning that the first mounting cavities 2111 of the first bracket 211 and the second bracket 212 are respectively located on the inner sides of the first supporting structure 21 and the second bracket 212. That is to say that when the first bracket 211 and the second bracket 212 are respectively arranged on the shell 11, the first mounting cavities 2111 of the first bracket 211 and the second bracket 212 are respectively at opposite positions to each other. The second mounting cavities 2112 are respectively on the outer sides of the first bracket 211 and the second bracket 212. The inner sides are the inward sides that the first bracket 211 and the second bracket 212 face toward each other. The outer sides are the opposite outward sides of the first bracket 211 and the second bracket 212. The second connector 312 comprises a first extension portion 3122. The first extension portion 3122 is extended outward from a side of the first connecting portion 3121, such that the first extension portion 3122 can be embedded and arranged in the first mounting cavity 2111.

Further, the first connector 311 also comprises a first guiding pillar 3113. The first connecting portion 3121 has a first perforation 31212. The first extension portion 3122 has a second perforation 31220. The first perforation 31212 communicates with the second perforation 31220.

The first guiding pillar 3113 is then able to pass through the first perforation 31212 and the second perforation 31220 at the same time, so as to strengthen the connection between the first bracket 211 and the shell 11 through the first connector 311 and the connection between the second bracket 212 and the shell 11 through the second connector 312. The first connecting unit 31 further comprises a third connector 313. The third connector 313 comprises a first flake 3131 and a first locking piece 3132. The first flake 3131 has a first connecting hole 31310. The first locking piece 3132 penetrated the first connecting hole 31310 is connected to the first mounting hole 31130 of the first guiding pillar 3113, such that the first connector 311 is rotatably connected with the second connector 312. The first flake 3131 is in the second mounting cavity 2112.

The third connector 313 further comprises a first resilient element 3133 arranged on the first guiding pillar 3113. When the first connector 311 is connected with the second connector 312, the first resilient element 3133 is arranged in the second mounting cavity 2112, such that the first resilient element 3133 can keep the adjusted angle of the first bracket 211 and the second bracket 212 toward the shell 11. When the first bracket 211 and the second bracket 212 are adjusted relatively, the elastic stage of the first resilient element 3133 will be changed, so the first resilient element 3133 will be maintained in the adjusted status because of the elastic potential energy.

The second connecting unit 32 further comprises a fourth connector 321 and a fifth connector 322. The fourth connector 321 is provided on two the end portions 221 of the second supporting structure 22. The fifth connector 322 is respectively provided on the first lower end portion 300 of the first bracket 211 and the second lower end portion 500 of the second bracket 212. The meshingly rotating connection between the fourth connector 321 and the fifth connector 322 has the first bracket 211 and the second bracket 212 be rotatably connected with the second supporting structure 22.

Further, the fourth connector 321 comprises a second bottom end portion 3211 and a second meshing portion 3212. The second meshing portion 3212 is provided on the second bottom end portion 3211. The fifth connector 322 comprises a second connecting portion 3221 and a second extension portion 3222. The second extension portion 3222 is extended outward from a side of the second connecting portion 3221, such that the second meshing portion 3212 can be meshingly connected with the second connecting portion 3221. The second connecting portion 3221 has a second clamping portion 32211. The second clamping portion 32211 has a tooth structure matching with the second meshing portion 3212. In other words, the tooth structure of the second meshing portion 3212 can coupled with the tooth structure on the second clamping portion 32211, so that the second supporting structure 22 can be rotatably connected with the first bracket 211 and the second bracket 212 through the meshing between the first meshing portion 3112 and the first clamping portion 31211.

It is worth mentioning that the fourth mounting cavities 2122 of the first lower end portion 300 of the first bracket 211 and the second lower end portion 500 of the second bracket 212 are respectively located on the inner sides of the first supporting structure 21. That is to say that when the first bracket 211 and the second bracket 212 are respectively connected on the second supporting structure 22, the fourth mounting cavities 2111 of the first bracket 211 and the second bracket 212 are respectively at opposite positions to each other. The third mounting cavities 2121 are respectively on the outer sides of the first bracket 211 and the second bracket 212. The inner sides are the inward sides that the first bracket 211 and the second bracket 212 face toward each other. The outer sides are the opposite outward sides of the first bracket 211 and the second bracket 212. The fifth connector 322 comprises a second extension portion 3222. The second extension portion 3222 is extended outward from a side of the second connecting portion 3221, such that the second extension portion 3222 can be embedded and arranged in the third mounting cavity 2121.

Further, the fourth connector 321 also comprises a second guiding pillar 3213. The second connecting portion 3221 has a third perforation 32212. The second extension portion 3222 has a fourth perforation 32220. The third perforation 32212 communicates with the fourth perforation 32220.

The second guiding pillar 3213 is then able to pass through the third perforation 32212 and the fourth perforation 32220 at the same time, such that the first bracket 211 and the second bracket 212 can be connected with the second supporting structure 22 through the fourth connector 321 and the fifth connector 322. The second connecting unit 32 further comprises a sixth connector 323. The sixth connector 323 comprises a second flake 3231 and a second locking piece 3232. The second flake 3231 has a second connecting hole 32310. The second locking piece 3232 penetrated the second connecting hole 32310 is connected to the second mounting hole 32130 of the second guiding pillar 3213, such that the fourth connector 321 is rotatably connected with the fifth connector 322. The second flake 3231 is in the fourth mounting cavity 2122.

The sixth connector 323 further comprises a second resilient element 3233 arranged on the second guiding pillar 3213. When the fourth connector 321 is connected with the fifth connector 322, the second resilient element 3233 is arranged in the fourth mounting cavity 2122, such that the second resilient element 3233 can keep the adjusted angle of the first bracket 211 and the second bracket 212 toward the second supporting structure 22. When the first bracket 211 and the second bracket 212 are adjusted relatively, the elastic stage of the second resilient element 3233 will be changed, so the second resilient element 3233 will be maintained in the adjusted status because of the elastic potential energy.

Person skilled in the art may consider the structure of the first connector 311 is the same with it of the fourth connector 321, the structure of the second connector 312 is the same with it of the fifth connector 322, and the structure of the third connector 312 is the same with it of the sixth connector 323.

Figure 4:
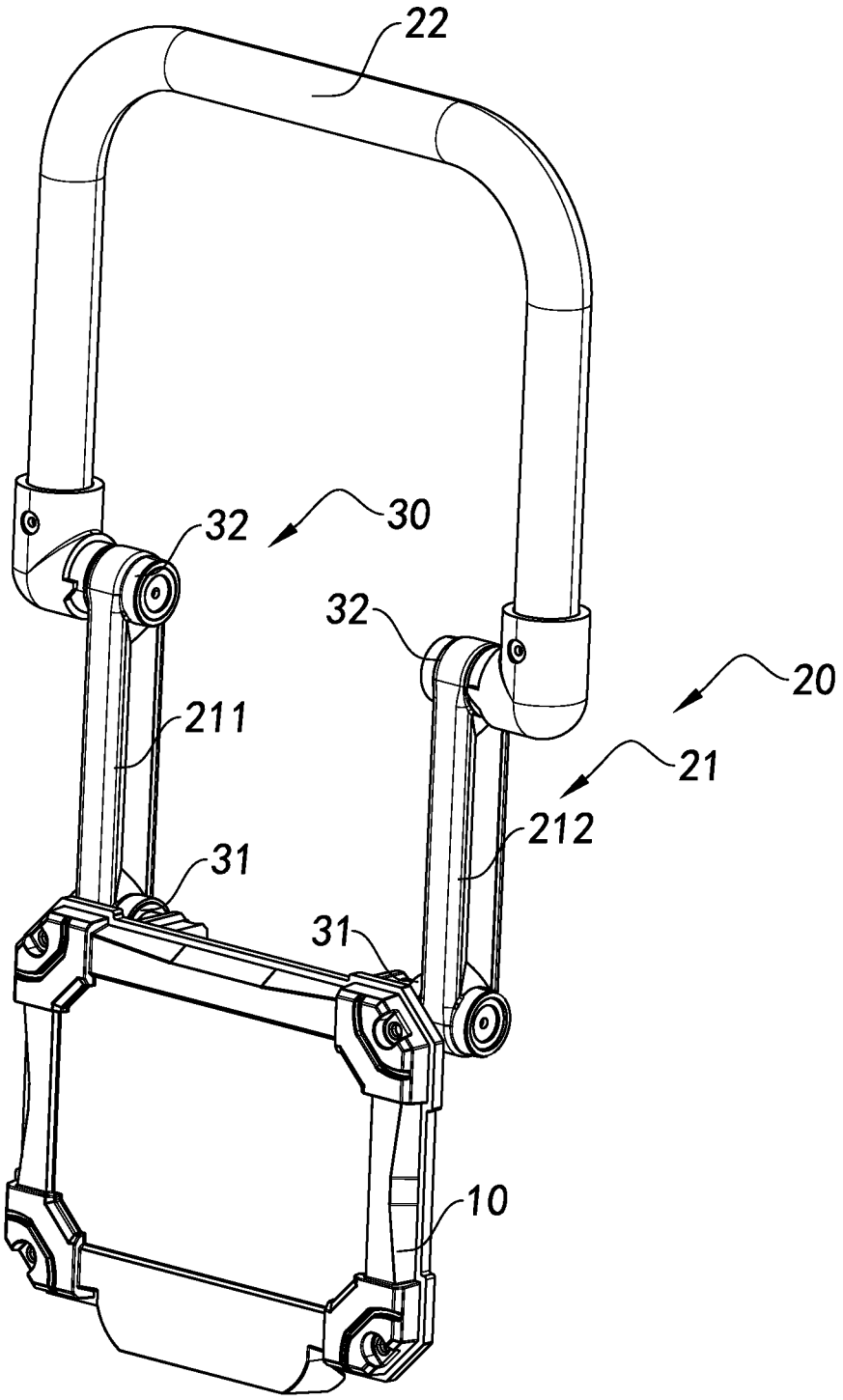
FIG. 4 is a perspective view illustrating an expanded mode of the lamp body and the supporting unit of the foldable lamp according to the above first preferred embodiment of the present invention.
Figure 5:
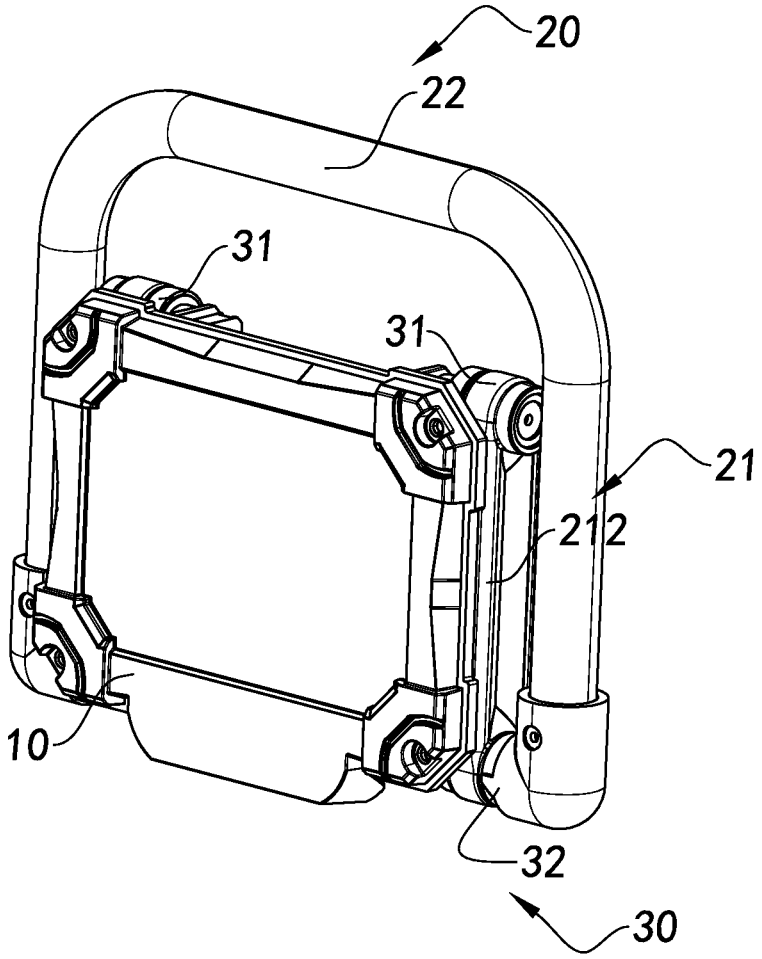
FIG. 5 is a perspective view illustrating a collapsed mode of the lamp body and the supporting unit of the foldable lamp according to the above first preferred embodiment of the present invention.
Figure 6:
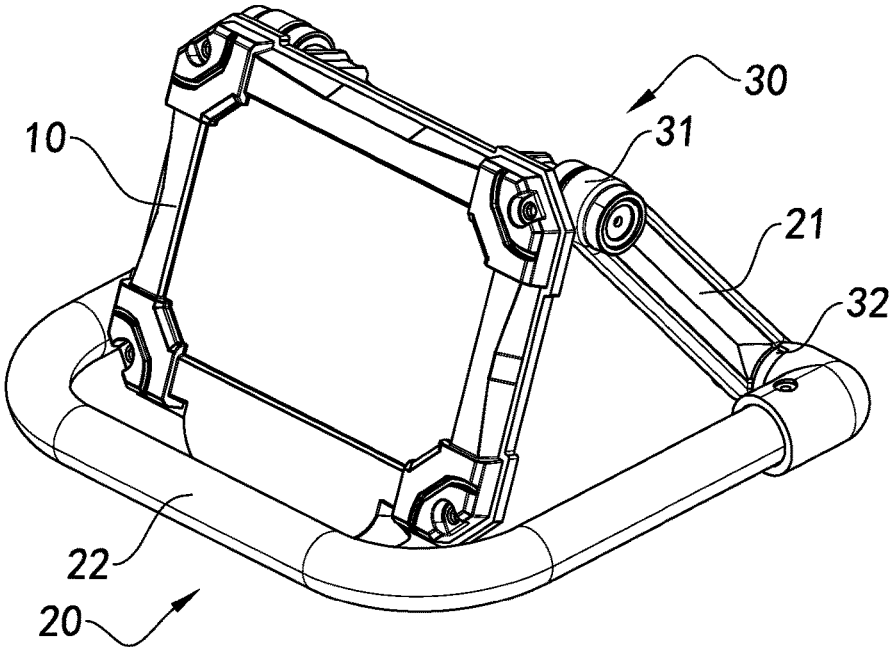
FIGS. 6-8 illustrate the foldable lamp in use according to the above first preferred embodiment of the present invention.
Figure 7:
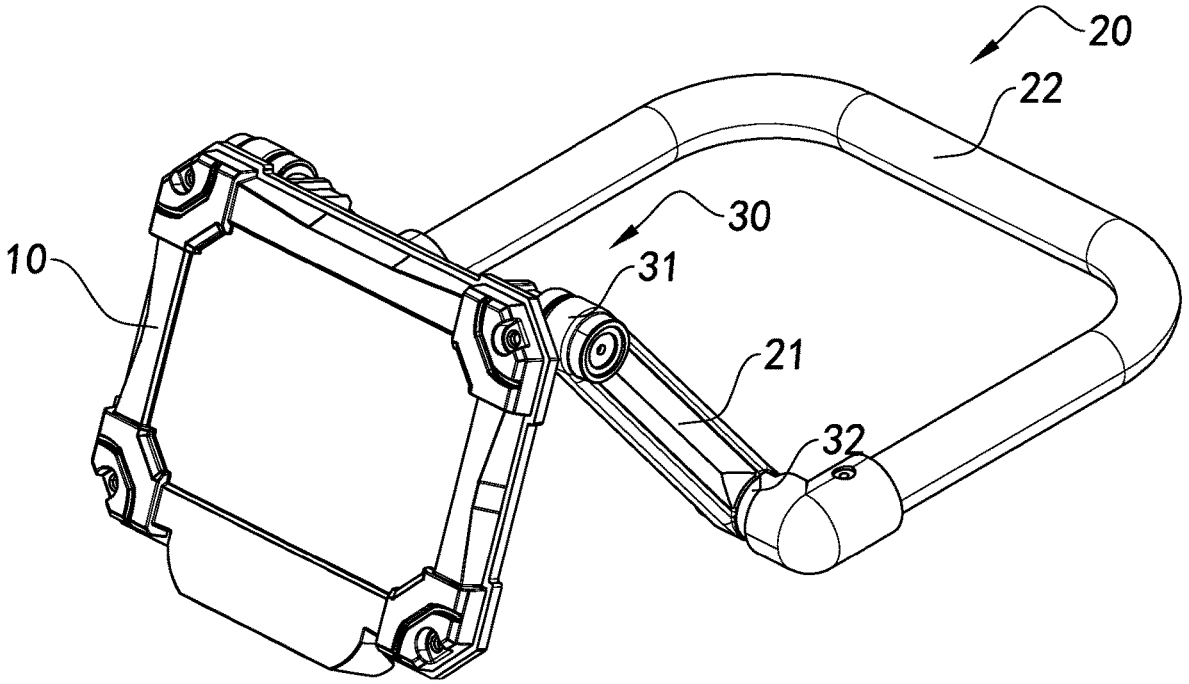

Referring to FIG. 4, when the lamp body 10 is rotatably connected with the supporting unit 20 through the connecting device 30, angle between the lamp body 10 and the first supporting structure 21 becomes adjustable, so as to satisfy the need of adjusting the illumination angle of the light source 12. Angle between the first supporting structure 21 and the second supporting structure 22 is also adjustable through rotation. The second supporting structure 22 serves as a base to support the lamp body 10 to be arranged on a horizontal. The lamp body 10, the first supporting structure 21, and the second supporting structure 22 can be 360 degree rotatably adjusted relatively to one another. The second supporting structure 22 may also serve as a hook to allow the foldable lamp being hung on a hanger. Referring to FIG. 5, when the foldable lamp is in the collapsed state, the lamp body 10, the first supporting structure 21, and the second supporting structure 22 can be accommodated in the accommodating chamber 220 at the same time. The size of the first supporting structure 21 is slightly larger than it of the lamp body 10, while the size of the second supporting structure 22 is slightly larger than it of the first supporting structure 21, such that the lamp body 10, the first supporting structure 21, and the second supporting structure 22 can all be accommodated into same plane at once, so as to reduce the storing or packaging space.

Figure 9:
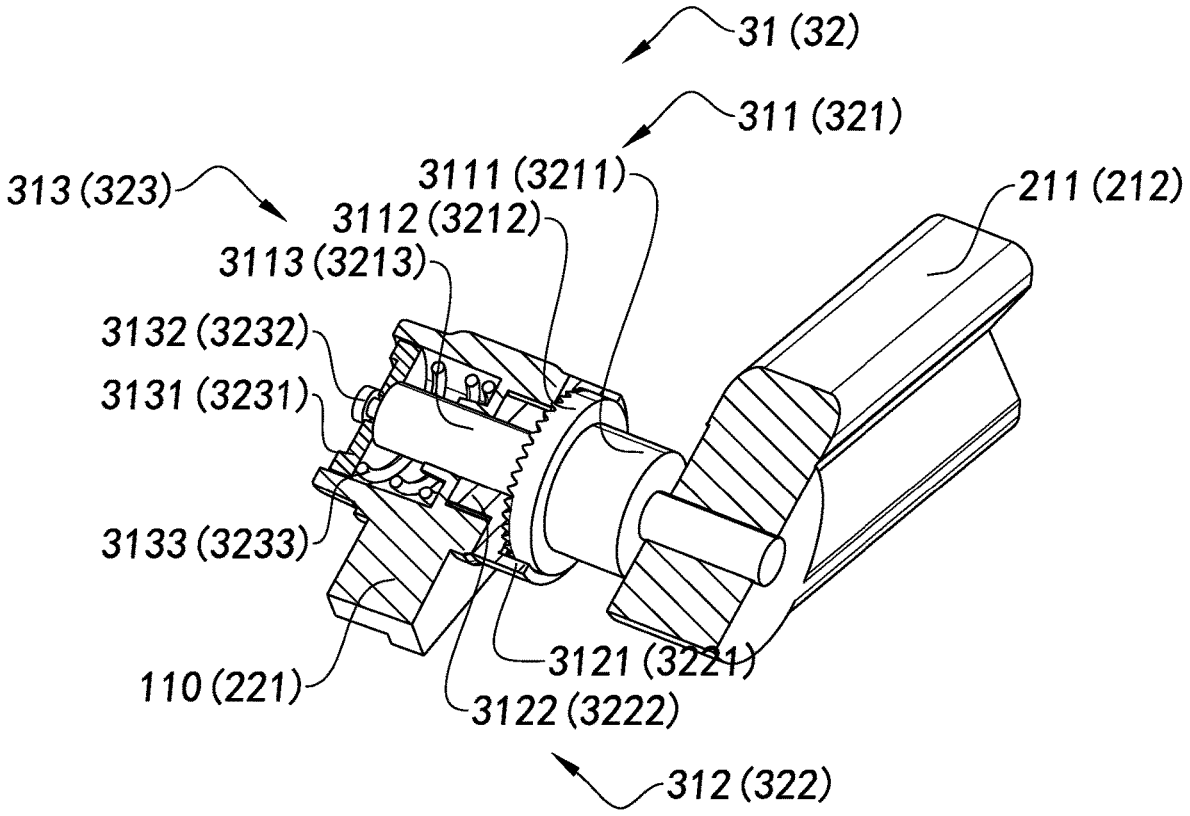
FIG. 9 is a perspective view of the foldable lamp according to a first alternative mode of the above first preferred embodiment of the present invention.

In an alternative mode of the first preferred embodiment as illustrated in FIG. 9, two the first connectors 311 are respectively arranged on the first bracket 211 and the second bracket 212, wherein each of the extension portions 110 respectively has the first mounting cavity 2111 and the second mounting cavity 2112. The differences of this alternative mode comparing with the previous preferred embodiment include different positions of the first connecting unit 31 and the mounting cavities on the first bracket 211 and the second bracket 212. Namely, in this alternative mode, the first connectors 311 are respectively arranged on the first bracket 211 and the second bracket 212; the extension portions 110 have the first mounting cavity 2111 and the second mounting cavity 2112; the second connector 312 and the third connector 313 can be arranged in the first mounting cavity 2111 and the second mounting cavity 2112 respectively and be rotatably connected with the first connectors 311. As a result, the second supporting structure 22 is rotatably connected with the lamp body 10 through the first supporting structure 21 respectively.

In another alternative mode of the first preferred embodiment of the present invention, two the first connectors 311 are respectively arranged on the first lower end portion 300 of the first bracket 211 and the second lower end portion 500 of the second bracket 212, wherein two the end portions 221 of the second supporting structure 22 respectively have the first mounting cavity 2111 and the second mounting cavity 2112. The differences of this alternative mode comparing with the previous preferred embodiment include different positions of the second connecting unit 32 and the mounting cavities on the first bracket 211 and the second bracket 212. Namely, in this alternative mode, the fourth connectors 321 are respectively arranged on the first bracket 211 and the second bracket 212; the end portions 221 respectively have the third mounting cavity 2121 and the fourth mounting cavity 2122; the fifth connector 322 and the sixth connector 323 can be arranged in the third mounting cavity 2121 and the fourth mounting cavity 2122 respectively and be rotatably connected with the fourth connector 321. As a result, the second supporting structure 22 is rotatably connected with the lamp body 10 through the first supporting structure 21 respectively.

Figure 8:
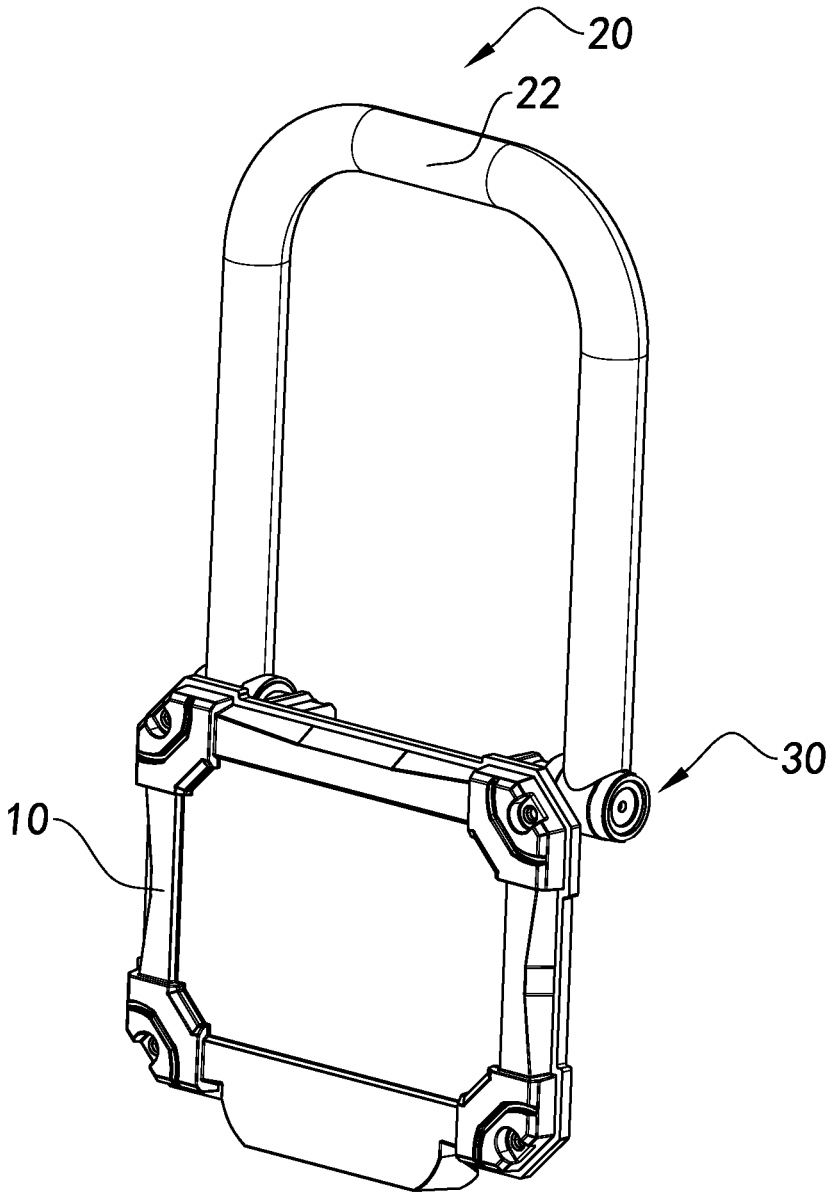

Referring to FIG. 8, in the above two alternative modes the second supporting structure 22 can be directly rotatably connected with the lamp body 10, so as to save the first supporting structure 21, such that the first supporting structure 21 can be arranged optionally according to user needs, which enhances the practicability thereof. The foldable lamp may still be laid on a horizontal or hung on a hanger through the second supporting structure 22.

Figure 10:
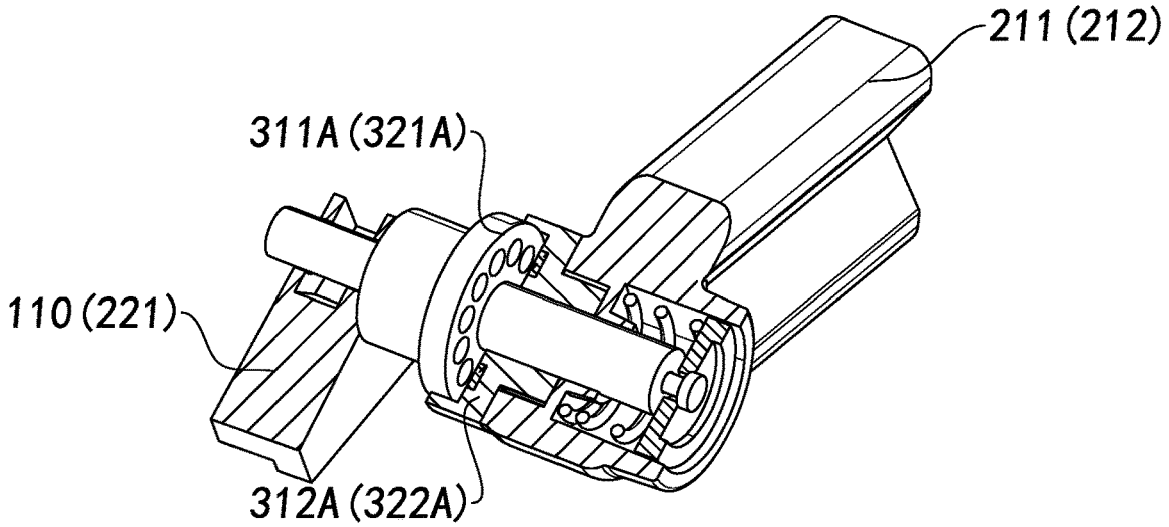
FIG. 10 is a perspective view of the foldable lamp according to a second alternative mode the above first preferred embodiment of of the present invention.

In an alternative mode as illustrated in FIG. 10, the first connector 311A, the second connector 312A, the third connector 321A, and the fourth connector 322A are respectively made of magnetic or binding material(s), such as magnet, adhesive object, and other materials that can bind with each other. The first connectors 311A are respectively provided on the extension portion 110. The second connectors 312A are arranged on the first bracket 211 and the second bracket 212. The first bracket 211 and the second bracket 212 are connected through rotatably coupling between the first connector 311A and the second connector 312A. The third connectors 321A are respectively provided on the first bracket 211 and the second bracket 212. The fourth connectors 322A are respectively arranged on two end portions 221 of the second supporting structure 22. The second supporting structure 22 is connected with the first bracket 211 and the second bracket 212 through the rotatable coupling between the third connector 321A and the fourth connector 322A. As a result, the second supporting structure 22 is rotatably connected with the lamp body 10 through the first supporting structure 21 respectively.

Figure 11:
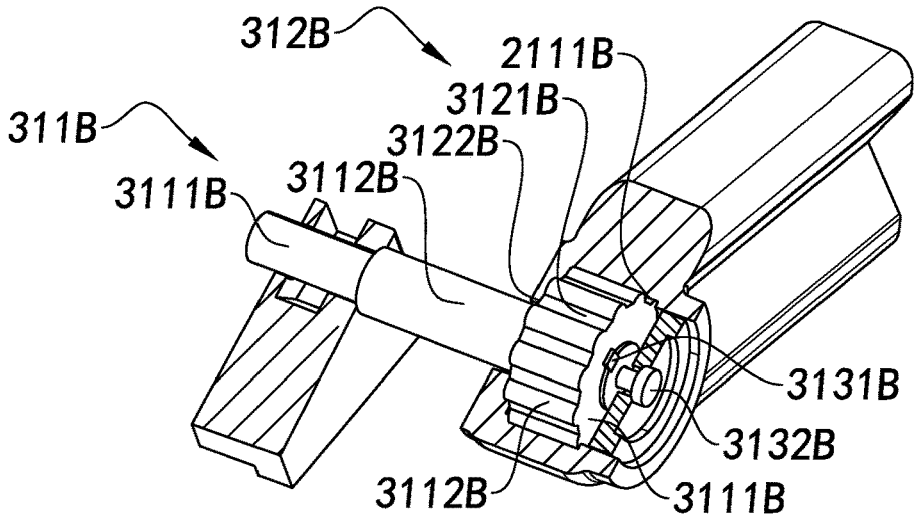
FIG. 11 is a perspective view of the foldable lamp according to a third alternative mode the above first preferred embodiment of of the present invention.
Figure 12:
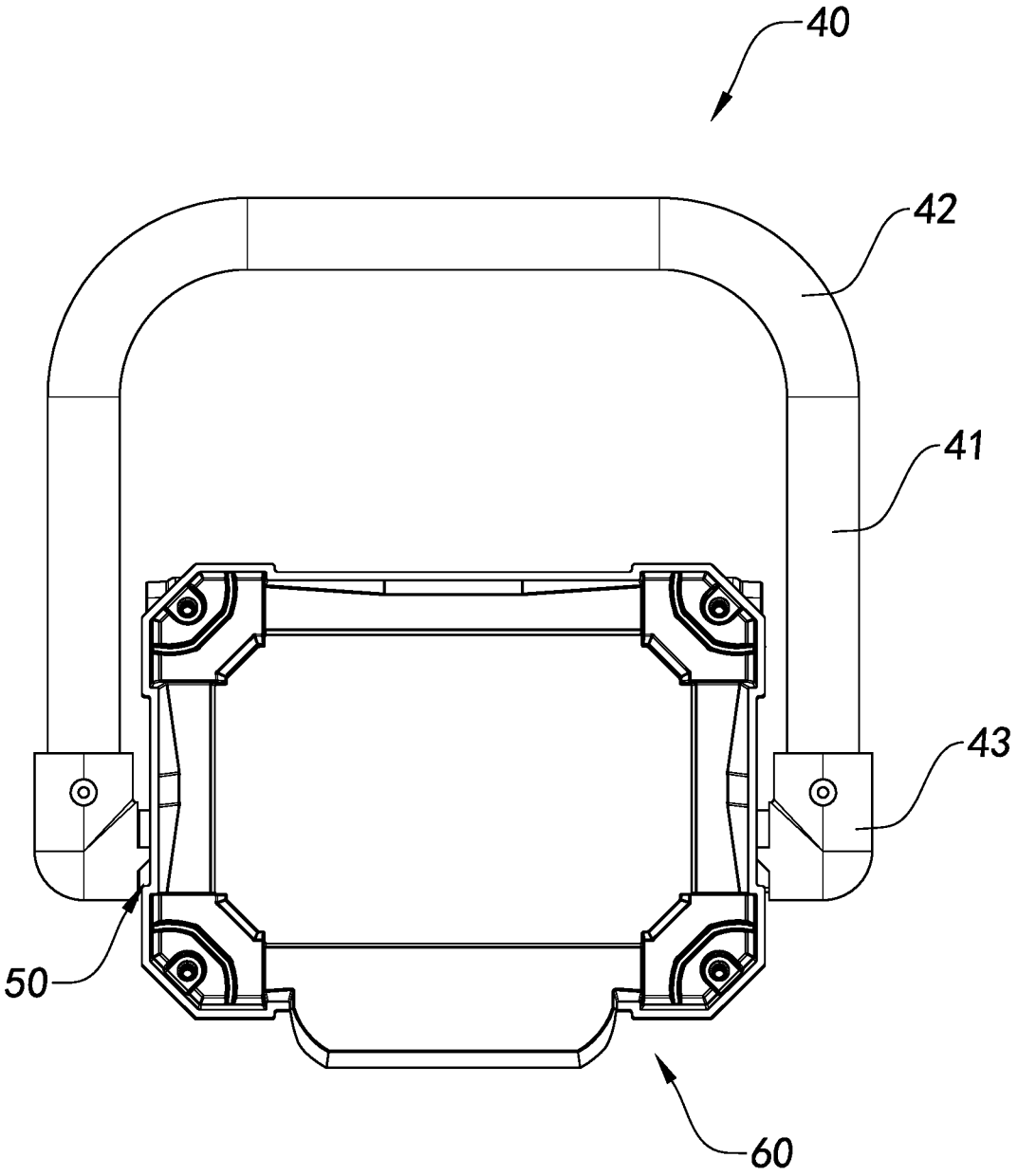
FIG. 12 is a front view of the foldable lamp according to a second preferred embodiment of the present invention.
Figure 13:
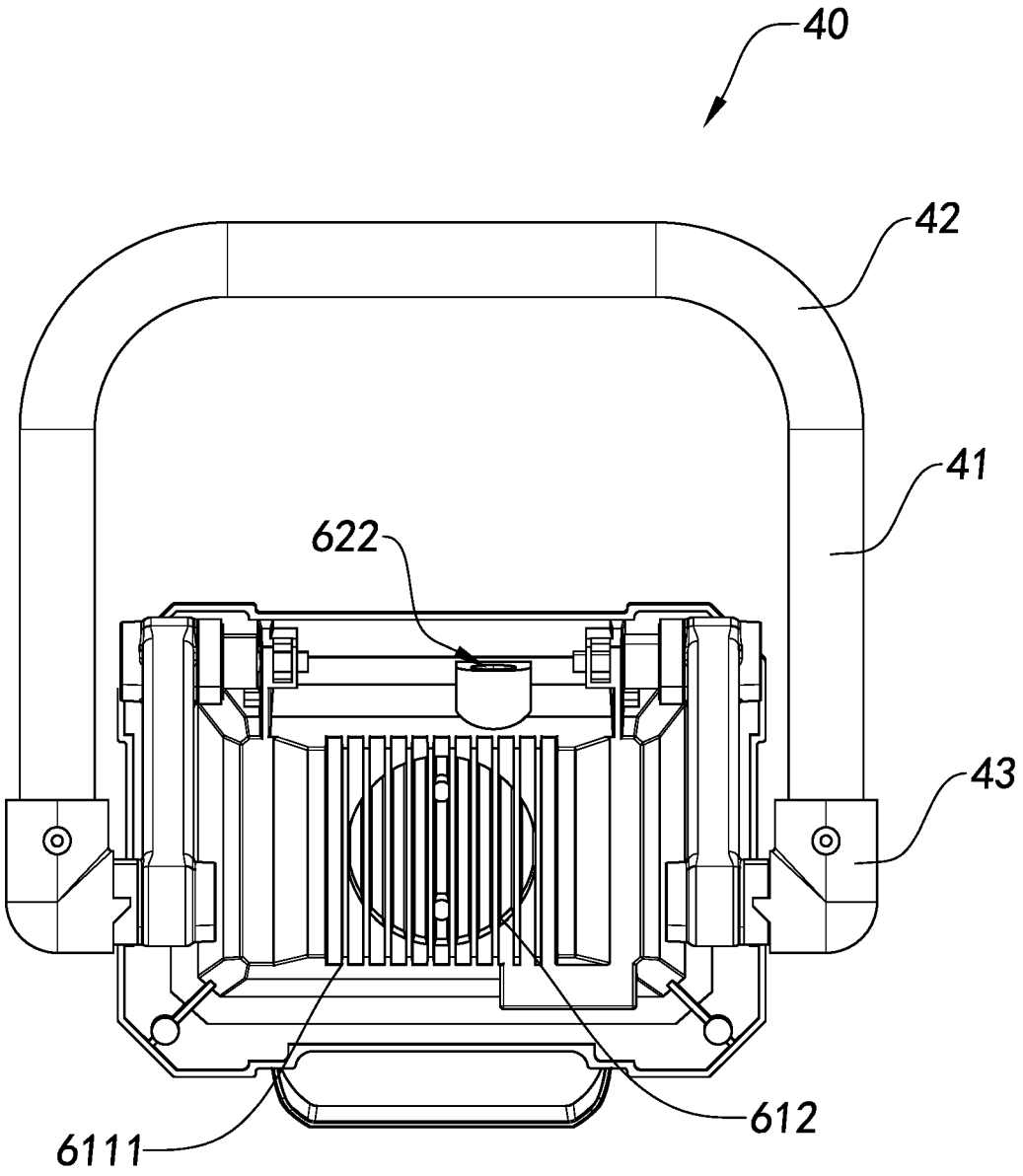
FIG. 13 is a back view of the foldable lamp according to the above second preferred embodiment of the present invention.
Figure 14:
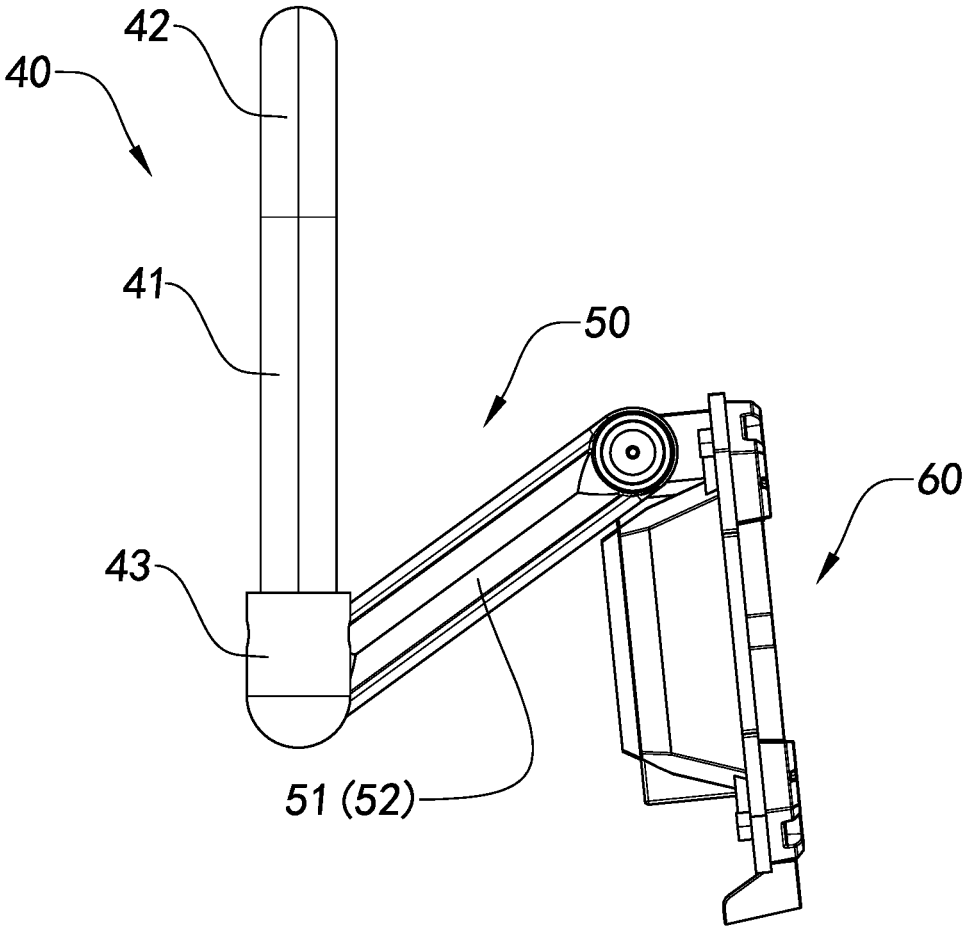
FIG. 14 is a left view of the foldable lamp according to the above second preferred embodiment of the present invention.
Figure 15:
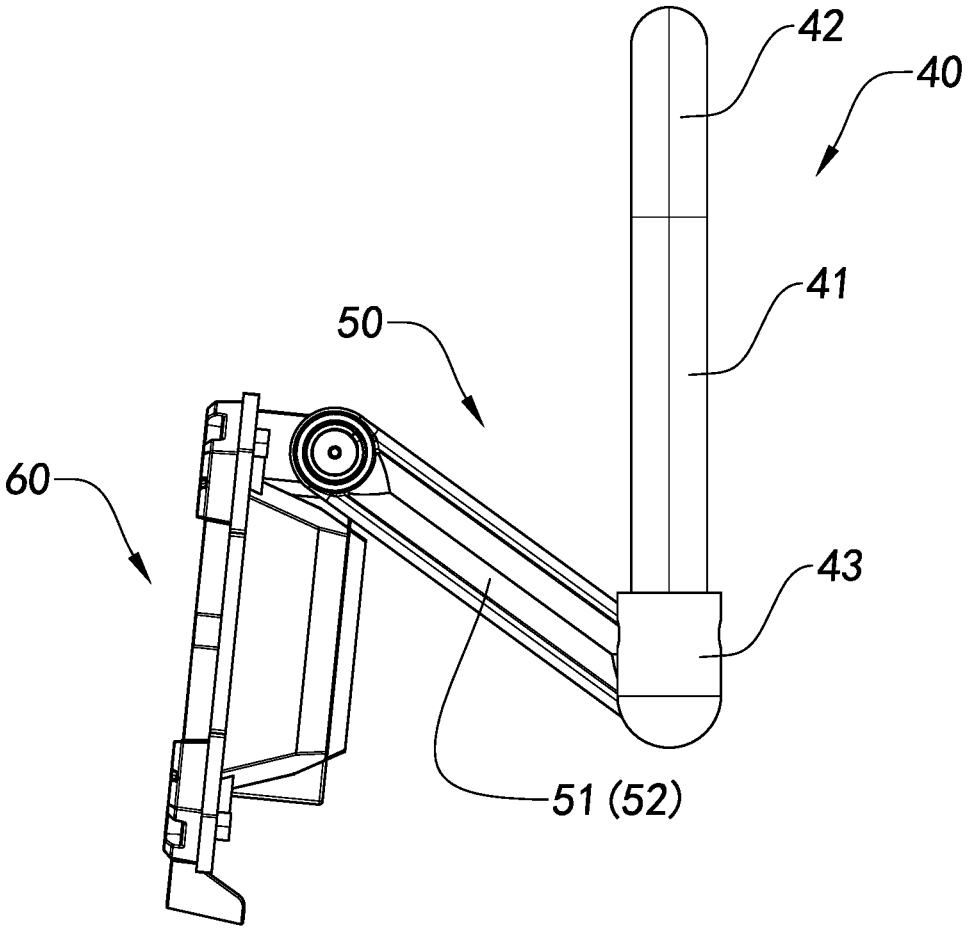
FIG. 15 is a right view of the foldable lamp according to the above second preferred embodiment of the present invention.
Figure 16:
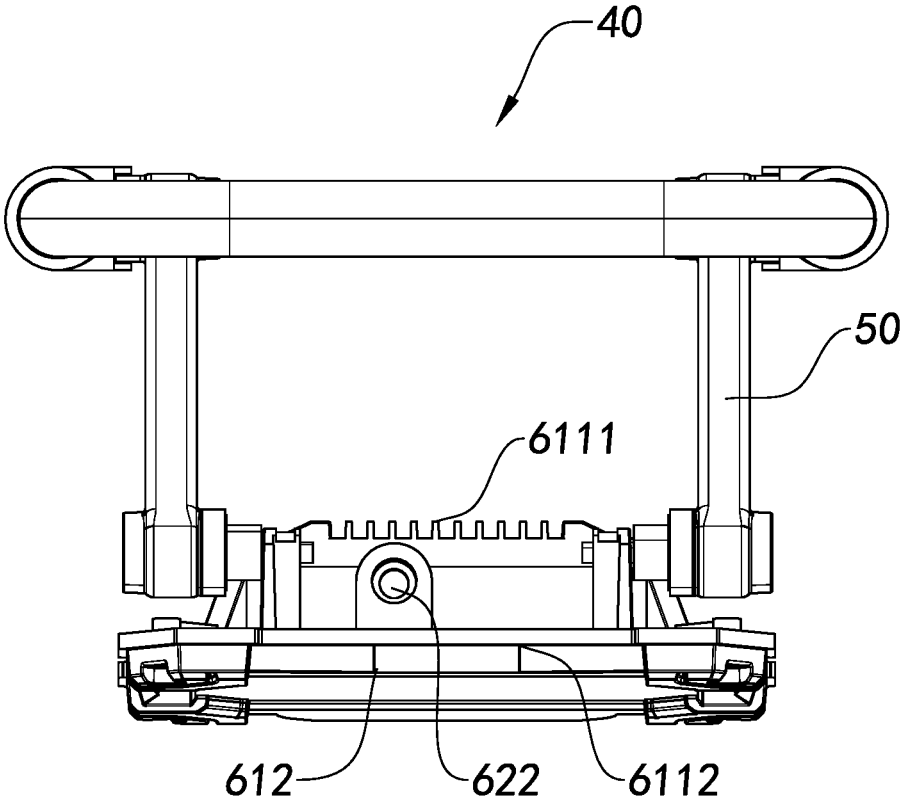
FIG. 16 is a bird's eye view of the foldable lamp according to the above second preferred embodiment of the present invention.

In the alternative mode as illustrated in FIG. 11, the first connectors 311B are respectively provided on the extension portion 100. The second connectors 312B are arranged on the first bracket 211 and the second bracket 212. The first bracket 211 and the second bracket 212 are connected through rotatably coupling between the first connector 311B and the second connector 312B. The first connector 311B comprises a first connecting portion 3111B and a second connecting portion 3112B. The second connector 312B comprises a wheel 3121B. The second connecting portion 3112B is connected with the wheel 3121B. The first connecting portion 3111B is arranged on the extension portion 110B, such that the first supporting structure 21B can be rotatably connected with the shell 11. A third connector 313B is arranged on the first connector 311B and the second connector 312B. The third connector 313B comprises a locking piece 3131B and a fastening piece 3132B. The locking piece 3131B is arranged on the second connecting portion 3112B for reinforcing the connection between the second connecting portion 3112B and the wheel 3121B. The wheel 3121B has a tooth structure for matching with the thread on the inside of the first supporting structure 21. Therefore, the wheel 3121B can rotate on the first supporting structure 21, so as to allow the lamp body 10, the first supporting structure 21, and the second supporting structure 22 to be rotatably connected with each other.

Embodiment Two

FIGS. 12-16 of the appended drawings of the present invention illustrated a second preferred embodiment of the present invention. According to the second preferred embodiment of the present invention, the foldable lamp comprises a supporting component 40, a folding component 50 and an illumination component 60. The supporting component 40 and the folding component 50 are foldably connected. The illumination component 60 and the folding component 50 are foldably connected as well. The folding component 50 and the illumination component 60 can be folded and hidden into the same plane of the supporting component 40 so as to reduce the volume of the foldable lamp for carrying with and transportation.

According to the second preferred embodiment of the present invention, the supporting component 40 comprises a support frame 41, two cushions 42 and two bends 43. The folding component 50 comprises a first connecting shaft 51 and a second connecting shaft 52. The illumination component 60 comprises an illumination assembly 61 and a power assembly 62, wherein the support frame 41 and the connecting shafts are connected through the bend 43. The connecting shafts are also connected with the illumination component 60. The cushions 42 are arranged on the support frame 41. All these structures are dismountable for reassembling in the future. Preferably, all these structures are assembled as a whole through an assembling device, so as to make its transportation and selling more convenient. The foldable lamp of the present invention can be disassembled and packed separately by the user.

According to the second preferred embodiment of the present invention, the supporting component 40 has a support frame 41. Preferably, the support frame 41 is integrally formed through moulding equipment that the support frame 41 can be put level on a plane surface, such as the ground, surface of other object, and etc. The support frame is preferably a U-shaped bracket. The two ends of the support frame 41 respectively have a bend 43 connected thereon. Each bent portion of the support frame 41 has a cushion 42 arranged thereon. When the support frame 41 is laid down, the cushion 42 can served to provide cushioning effect and protection. The cushion 42 is preferably made of flexible material. If the outdoor ground or the surface of other object is not flat, the cushion 42 can be distorted to turn it into a relatively flat surface.

Alternatively, the support frame 41 can be bent into a U-shaped bracket through a bending equipment, wherein the support frame 41 can be put level on a plane surface, such as the ground, surface of other object, and etc. The advantages of the U-shaped bracket include allowing the device be laid on a plane surface stably, keeping the device from toppling and falling as it was put on a uneven surface, etc.

It is understandable that the support frame 41 can easily be thought of being made into a supporting bracket of other shape, such as triangle, rectangular, trapezium, etc., instead of U-shape. A function of the support frame 41 is to support the foldable lamp. Because its major application environment is in the outdoor, where the ground or surface of other object are hardly even and level, therefore the support frame 41 should be stable and hard to be toppled or fallen.

The bends 43 are respectively arranged on two ends of the support frame 41. Preferably, the bend 43 is a 90° bend. The inside diameter of the bend 43 is slightly greater than the diameter of the two ends of the support frame 41. An end of the bend 43 has a screw hole thereon. An end of the support frame 41 has a screw hole correspondingly. When an end of the bend 43 is inserted into an end of the support frame 41, the two screw holes on the bend 43 and the support frame 41 are correspondingly communicated, so as to be connected and secured through a bolt. The direction of other end of the bend 43 is toward the inner side of the support frame 41.

Further, the support frame 41 defines a semi-encircled internal plane area. When the folding component 50 and the illumination component 60 are folded and keep flat on the same plane to the support frame 41, the internal plane area of the support frame 41 can accommodate the folding component 50 and the illumination component 60, so as to hide the folding component 50 and the illumination component 60 and reduce the overall volume for easier carrying and transportation.

According to the second preferred embodiment of the present invention, the folding component 50 has a first connecting shaft 51 and a second connecting shaft 52. An end of the connecting shaft is connected to the bend 43 of the support frame 41 through bolt fastening or direct nesting, so as to be freely rotatable around the bend 43 of the support frame 41. By utilizing the bends 43 as axes, the first connecting shaft 51 and the second connecting shaft 52 can be folded to the internal plane area of the support frame 41 and turned to unfold the folding component. Further, the connecting shaft can be rotated in any angle around the bend 43 of the support frame 41.

According to the second preferred embodiment of the present invention, the illumination component 60 comprises an illumination assembly 61 and a power assembly 62. The illumination assembly 61 provides a lighting source for the user. The power assembly 62 provides power for the illumination assembly 61 to shine. The illumination assembly 61 has a lamp holder 611 and a lamp 612. The power assembly 62 comprises a power source 621, a switch 622, and a power connector 623. The power assembly 62 is installed inside of the illumination component 60. The switch 622 is arranged on the back side of the lamp holder 611. The power source 621 is electrically connected with the lamp 612 through the power connector 623. The switch 622 can be utilized to turn on and off the power source 621. Preferably, the illumination assembly 61 is made of waterproof material, so as to keep the illumination assembly 61 and the power assembly 62 from external interference of outside environment.

The lamp 612 can be a general lamp. The lamp holder 611 is adapted for most lamps in the market to be installed thereon, so as to allow the lamp holder 611 to be suitable for more lamps and to enhance the practicability of the lamp holder 611. Two sides of the lamp holder 611 respectively have a bend 43 thereon. The bends 43 and the folding component are connected. The folding component can be rotated around the bends 43 so as to adjust the relative positions between the folding component and the illumination component.

Another end of the connecting shaft is connected to the bend 43 of the lamp holder 611 of the illumination component 60. Preferably, the lamp holder 611 is connected to the connecting shaft through bolt fastening or direct nesting that allows the lamp holder 611 to be freely rotated around the connecting shaft.

Further, the connecting shaft can be rotated around the bend 43 of the support frame 41 so as to allow adjustment the angle of the connecting shaft if needed. Preferably, the connection between the connecting shaft and the bend 43 of the support frame 41 is tight, which requires to put a predetermined force to alter the relative positions thereof. As the connecting shaft reaches a certain angle, its position will be held so as for a better illumination result.

Further, the lamp holder 611 of the illumination assembly 61 and the other end of the connecting shaft are connected through bolt fastening or direct nesting. The illumination assembly 61 can be freely rotated around the other end of the connecting shaft of the folding component 50. When the illumination assembly 61 has to be adjusted to a specific angle, the relative position thereof can be changed through a predetermined force. Then the position of the illumination assembly 61 is held so as for a better illumination result.

The front side of the lamp holder 611 has a lampshade 6112 that is able to expand the illumination of the lamp 612. The back side of the lamp holder 611 has a heat dissipation structure 6111 because the lamp 612 in use, especially for a long time, will generate heat. The heat dissipation structure 6111 is preferably a fence, so as to expand the heat dissipation area and to ensure heat generated by the lamp 612 be dispersed timely, which keeps the safety and stability of the material of the foldable lamp. If the heat cannot be dispersed, the rising temperature will somehow damage the overall structure of the foldable lamp and make it difficult for the user to carry it with or move it.

It is understandable that the rotation of the illumination component to the supporting component has two degrees of freedom, while rotation of a conventional illumination component has only one degree of freedom. In a practical scenario, it can need more rotations in order to achieve a better illumination result. Therefore, the illumination component 60 of the present invention can be rotated and folded in two degrees of freedom.

According to an embodiment of the present invention, when the supporting component 40 is affixed, one may define the two ends of the support frame 41 a horizontal X axis and a vertical Y axis perpendicular to the X axis. Since the connecting shaft be arranged on the support frame 41 through a bend 43, the connecting shaft will have a degree of freedom to rotate around the X axis. Since the first and the second connecting shaft are arranged in parallel, a Z axis will be formed on the other ends of the first and the second connecting shaft, wherein the X axis is parallel to the Z axis. The illumination component is connected to the other ends of the first and the second connecting shaft, so that the illumination component will have a degree of freedom to rotate around the Z axis. Hence, the illumination component of the present invention has two degrees of freedom to rotate relatively to the support frame.

When the support frame 41 is affixed on a plane surface of an object, the user may expand the connecting shaft, expand the illumination component 60, and obtain a required illumination angle through adjusting the relative positions between the connecting shaft and the illumination component 60.

According to the second preferred embodiment of the present invention, the folding component 50 and the connecting shaft define a second internal plane area therebetween. Preferably, when the folding component 50 is folded and hidden in the supporting component 40, the second internal plane area is included by the first internal plane area, wherein the second internal plane area is able to accommodate the illumination component 60. When the illumination component 60 is folded in the second internal plane area of the folding component 50, the illumination component 60 can be hidden in the second internal plane area. The illumination component 60 and the folding component 50 can be folded and secured in the first internal plane area through adjusting the relative positions between the illumination assembly 61 and the connecting shaft. When the foldable lamp is not in use, the foldable lamp can be folded to reduce its volume for portability.

According to an embodiment of the present invention, the support frame 41 further forms a handle. When the illumination component 60 and the folding component 50 are folded and secured in the first internal plane area, the user may grip the handle to carry the foldable lamp. The major application environment of the foldable lamp is in the outdoor, so the foldable lamp has to be carried with for moving to different places.

According to an embodiment of the present invention, the connecting shaft can be disassembled from and reassemble to the support frame. The illumination component can also be disassembled from and reassemble to the connecting shaft. When the foldable lamp is to be carried and stored, it can be disassembled into several parts to be carried separately. The user can reassemble the foldable lamp when he/she arrived to the destination.

According to an embodiment of the present invention, the power assembly of the illumination assembly can be a multi-power-resource power assembly that comprises a regular power assembly and a solar power assembly. The regular power assembly comprises a regular power source, a switch, and a power connector, wherein the regular power source is connected with the lamp through the power connector and the switch is able to turn on and off the power connector. The solar power assembly comprises a solar power collector, a solar power storage, a switch, and a power connector, wherein the solar power collector is arranged on the back of the illumination assembly. The regular power assembly is installed in the inside of the illumination assembly. The solar power assembly is arranged on the back of the illumination assembly. The switch can turn on and off the power connector. Electricity collected by the solar power collector will be stored in the solar power storage so as to be connected for the illumination of the lamp of the foldable lamp when needed.

When the user needs to turn on the light, he/she may choose to turn on one of the switches of the power assembly, wherein the power assembly is connected with the illumination assembly. The advantages of solar power assembly include providing a reusable clean energy for the foldable lamp and solving the problem of outdoor power insufficiency.

According to an embodiment of the present invention, the supporting component of the foldable lamp further has a securing arrangement, wherein when the folding component and the illumination component are folded and hidden in the supporting component, the user may utilize the securing arrangement to fasten the folding component and the illumination component, so as to prevent the folding component and the illumination component from being damaged during transportation. The securing arrangement is arranged on two sides of the supporting component. The securing arrangement has a buckle. The folding component and the illumination component can be fastened by the buckle of the securing arrangement.

According to an embodiment of the present invention, the folding component of the foldable lamp is connected to the supporting component through the bend 43, wherein an end of the supporting component and an end of the folding component are respectively nested in the two ends on the bend 43. The tightness of the connections requires the user to exert a certain pulling force to alter the relative positions between the folding component and the supporting component. Besides, it strengthens the structure of the foldable lamp for being adapted to variable outdoor environment, and makes the foldable lamp suitable for adult use by avoiding the relative position of the foldable lamp being changed due to minor's touch.

Further, the illumination component is arranged on the folding component through the bend 43, wherein the illumination component and the folding component require the user to exert a certain pulling force to alter their relative positions. This not only makes its structure firmer to be adapted to variable outdoor environment, but also makes it suitable for adult use by avoiding the relative position of the foldable lamp being changed due to minor's touch.

According to the second preferred embodiment of the present invention, person skilled in the art can easily think of utilizing remote controlling on switching on and off the foldable lamp, wherein the remote control device comprises a controlling element, an actuator, and a signal transmission element. The actuator and the signal transmission element are both installed at the joint between the folding component and the supporting component and the joint between the illumination component and the folding component. The remote control element transmits a signal through the signal transmission element to command the actuator to execute corresponding action, wherein the remote control element can be installed on a terminal device.

According to an embodiment of the present invention, the illumination component further has a grippable handle part. When it has to expand the foldable lamp, one may grip the handle part to expand the foldable lamp.

One skilled in the art will understand that the embodiment of the present invention as shown in the drawings and described above is exemplary only and not intended to be limiting.

Objectives of the present invention are completely and effectively implemented. Notions of the functions and structures of the present invention have been shown and described in the embodiments, whereas implementations of the present invention may have modifications or changes in any ways without going against the above notions.

What is claimed is:

1. A foldable lamp, comprising:

a supporting unit, providing an accommodation and comprising a first supporting structure and a second supporting structure, wherein said first supporting structure further comprises a first bracket and a second bracket symmetrical to said first bracket, wherein two end portions of said second bracket are rotatably connected with a first lower end portion of said first bracket and a second lower end portion of said second bracket respectively;

a lamp body, rotatably arranged on said supporting unit, such that said foldable lamp has a collapsed state and an expanded state to be switched therebetween, wherein when the foldable lamp is in the collapsed state, said lamp body is accommodated in said accommodation of said supporting unit, such that said supporting unit surrounds around said lamp body, which reduces a volume of said foldable lamp under said collapsed state, wherein said first upper end portion of said first bracket and said second upper end portion of said second bracket are pivotally connected to two sides of said lamp body respectively; and a connecting device, comprising two first connecting units and two second connecting units, wherein said first upper end portion of said first bracket and said second upper end portion of said second bracket are rotatably connected to two sides of said lamp body through each said first connecting unit respectively, wherein said end portions of said second supporting structure are rotatably connected with said first lower end portion of said first bracket and said second lower end portion of said second bracket respectively through said second connecting units respectively, wherein said first connecting unit comprises a first connector and a second connector, wherein said first connector is provided on an extension portion of said lamp body, wherein said second connector is provided on said first bracket and said second bracket of said first supporting structure, wherein said first connector is rotatably connected with said second connector, such that said first bracket and said second bracket are rotatably connected with said lamp body, wherein said first connector comprises a first bottom end portion and a first meshing portion, wherein said first meshing portion is provided on said first bottom end portion, wherein said first bottom end portion is connected with said extension portion, wherein said second connector comprises a first connecting portion and a first extension portion, wherein said first connecting portion has a first clamping portion, wherein said first clamping portion is meshingly connected with said first meshing portion, such that said first connector is rotatably connected with said second connector.

2. The foldable lamp, as recited in claim 1, wherein said first connector comprises a first guiding pillar, wherein said first connecting portion has a first perforation and said first extension portion has a second perforation, wherein said first guiding pillar penetrates said first perforation and said second perforation so as to attach an attaching surface of said first connector and an attaching surface of said second connector, wherein said attaching surface of said first connector and said attaching surface of said second connector have a position tooth respectively, such that said first connector and said second connector stay still by meshing said position tooth of said attaching surface of said first connector and said position tooth of said attaching surface of said second connector.

3. The foldable lamp, as recited in claim 2, wherein said fourth connector comprises a second bottom end portion and a second meshing portion provided on said second bottom end portion, wherein said second bottom end portion is connected with said end portion, wherein said fifth connector comprises a second connecting portion and a second extension portion, wherein said second connecting portion has a second clamping portion meshingly connected with said second meshing portion, such that said fourth connector is rotatably connected with said fifth connector, wherein said fourth connector comprises a second guiding pillar, wherein said second connecting portion has a third perforation, wherein said second extension portion has a fourth perforation, wherein said second guiding pillar penetrates said third perforation and said fourth perforation so as to attach an attaching surface of said third connector and an attaching surface of said fourth connector, wherein said attaching surface of said third connector and said attaching surface of said fourth connector have a position tooth respectively, so as to allow said third connector and said fourth connector to hold each other still by meshing said position tooth of said attaching surface of said third connector and said position tooth of said attaching surface of said fourth connector.

4. The foldable lamp, as recited in claim 2, wherein said first connecting unit comprises a first flake and a first locking piece, wherein said first flake has a first connecting hole and said first guiding pillar has a first mounting hole, wherein said first locking piece penetrated said first connecting hole is held in said first mounting hole so as to tightly attach an attaching surface of said first connector with an attaching surface of said second connector.

5. The foldable lamp, as recited in claim 3, wherein said fourth connecting unit comprises a second flake and a second locking piece, wherein said second flake has second connecting hole and said second guiding pillar has a second mounting hole, wherein said second locking piece penetrated said second connecting hole is held in said second mounting hole so as to tightly attach said attaching surface of said third connector with said attaching surface of said fourth connector.

6. The foldable lamp, as recited in claim 2, wherein said first connecting unit comprises a third connector, wherein said third connector comprises a first resilient element arranged on said first guiding pillar to reinforce the attachment between said attaching surface of said first connector and said attaching surface of said second connector.

7. The foldable lamp, as recited in claim 3, wherein said first connecting unit comprises a third connector, wherein said third connector comprises a first resilient element arranged on said first guiding pillar to reinforce the attachment between said attaching surface of said first connector and said attaching surface of said second connector.

8. The foldable lamp, as recited in claim 7, wherein said second connecting unit comprises a sixth connector strengthening the connection between said third connector and said fourth connector and holding said second supporting structure and said first supporting structure on an adjusted angle, wherein said sixth connector comprises a second resilient element arranged on said second guiding pillar to reinforce the attachment between said attaching surface of said third connector and said attaching surface of said fourth connector.

9. A foldable lamp, comprising:

a supporting unit, providing an accommodation and comprising a first supporting structure and a second supporting structure, wherein said first supporting structure further comprises a first bracket and a second bracket symmetrical to said first bracket, wherein two end portions of said second bracket are rotatably connected with a first lower end portion of said first bracket and a second lower end portion of said second bracket respectively;

a lamp body, rotatably arranged on said supporting unit, such that said foldable lamp has a collapsed state and an expanded state to be switched therebetween, wherein when the foldable lamp is in the collapsed state, said lamp body is accommodated in said accommodation of said supporting unit, such that said supporting unit surrounds around said lamp body, which reduces a volume of said foldable lamp under said collapsed state, wherein said first upper end portion of said first bracket and said second upper end portion of said second bracket are pivotally connected to two sides of said lamp body respectively; and a connecting device, comprising two first connecting units and two second connecting units, wherein said first upper end portion of said first bracket and said second upper end portion of said second bracket are rotatably connected to two sides of said lamp body through each said first connecting unit respectively, wherein said end portions of said second supporting structure are rotatably connected with said first lower end portion of said first bracket and said second lower end portion of said second bracket respectively through said second connecting units respectively, wherein each of said second connecting unit comprises a fourth connector and a fifth connector, wherein said fourth connectors are respectively provided on two said end portions of said second supporting structure, wherein said fifth connectors are provided on said first bracket and said second bracket of said first supporting structure respectively, wherein said fourth connectors are rotatably connected with said fifth connectors respectively, such that two said end portions of said second supporting structure are rotatably connected with said first bracket and said second bracket respectively, wherein said fourth connector comprises a second bottom end portion and a second meshing portion provided on said second bottom end portion, wherein said second bottom end portion is connected with said end portion, wherein said fifth connector comprises a second connecting portion and a second extension portion, wherein said second connecting portion has a second clamping portion meshingly connected with said second meshing portion, such that said fourth connector is rotatably connected with said fifth connector, wherein said fourth connector comprises a second guiding pillar, wherein said second connecting portion has a third perforation, wherein said second extension portion has a fourth perforation, wherein said second guiding pillar penetrates said third perforation and said fourth perforation so as to attach an attaching surface of said third connector and an attaching surface of said fourth connector, wherein said attaching surface of said third connector and said attaching surface of said fourth connector have a position tooth respectively, so as to allow said third connector and said fourth connector to hold each other still by meshing said position tooth of said attaching surface of said third connector and said position tooth of said attaching surface of said fourth connector.

10. The foldable lamp, as recited in claim 9, wherein said second connecting unit comprises a sixth connector strengthening the connection between said third connector and said fourth connector and holding said second supporting structure and said first supporting structure on an adjusted angle, wherein said sixth connector comprises a second resilient element arranged on said second guiding pillar to reinforce the attachment between said attaching surface of said third connector and said attaching surface of said fourth connector.

11. A foldable lamp, comprising:

a supporting unit, providing an accommodation and comprising a first supporting structure and a second supporting structure, wherein said first supporting structure further comprises a first bracket and a second bracket symmetrical to said first bracket, wherein two end portions of said second bracket are rotatably connected with a first lower end portion of said first bracket and a second lower end portion of said second bracket respectively;

a lamp body, rotatably arranged on said supporting unit, such that said foldable lamp has a collapsed state and an expanded state to be switched therebetween, wherein when the foldable lamp is in the collapsed state, said lamp body is accommodated in said accommodation of said supporting unit, such that said supporting unit surrounds around said lamp body, which reduces a volume of said foldable lamp under said collapsed state, wherein said first upper end portion of said first bracket and said second upper end portion of said second bracket are pivotally connected to two sides of said lamp body respectively; and a connecting device, comprising two first connecting units and two second connecting units, wherein said first upper end portion of said first bracket and said second upper end portion of said second bracket are rotatably connected to two sides of said lamp body through each said first connecting unit respectively, wherein said end portions of said second supporting structure are rotatably connected with said first lower end portion of said first bracket and said second lower end portion of said second bracket respectively through said second connecting units respectively, wherein said first connecting unit comprises a first connector and a second connector, wherein said first connector is provided on said extension portion of said lamp body, wherein said second connector is provided on said first bracket and said second bracket of said first supporting structure, wherein said first connector is rotatably connected with said second connector, such that said first bracket and said second bracket are rotatably connected with said lamp body, wherein each of said second connecting units comprises a fourth connector and a fifth connector, wherein said fourth connectors are respectively provided on two said end portions of said second supporting structure, wherein said fifth connectors are provided on said first bracket and said second bracket of said first supporting structure respectively, wherein said fourth connectors are rotatably connected with said fifth connectors respectively, such that two said end portions of said second supporting structure are rotatably connected with said first bracket and said second bracket respectively, wherein said fourth connector comprises a second bottom end portion and a second meshing portion provided on said second bottom end portion, wherein said second bottom end portion is connected with said end portion, wherein said fifth connector comprises a second connecting portion and a second extension portion, wherein said second connecting portion has a second clamping portion meshingly connected with said second meshing portion, such that said fourth connector is rotatably connected with said fifth connector, wherein said fourth connector comprises a second guiding pillar, wherein said second connecting portion has a third perforation, wherein said second extension portion has a fourth perforation, wherein said second guiding pillar penetrates said third perforation and said fourth perforation so as to attach an attaching surface of said third connector and an attaching surface of said fourth connector, wherein said attaching surface of said third connector and said attaching surface of said fourth connector have a position tooth respectively, so as to allow said third connector and said fourth connector to hold each other still by meshing said position tooth of said attaching surface of said third connector and said position tooth of said attaching surface of said fourth connector.

* * * * *